US007708595B2

(12) United States Patent
Chow et al.

(10) Patent No.: US 7,708,595 B2
(45) Date of Patent: May 4, 2010

(54) ELECTRICAL CONNECTOR SYSTEM WITH MAGNETIC MODULE

(75) Inventors: John Chow, Saratoga, CA (US); Li-Chun Wu, Tu-Cheng (TW); Chao-Tung Huang, Tu-Cheng (TW); Chih-Min Lin, Tu-Cheng (TW); Jie Zhang, Kunshan (CN); Yong-Chun Xu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/556,588

(22) Filed: Sep. 10, 2009

(65) Prior Publication Data

US 2010/0062625 A1 Mar. 11, 2010

(30) Foreign Application Priority Data

| | | |
|---|---|---|
| Sep. 10, 2008 | (CN) | 2008 2 0302066 |
| Sep. 16, 2008 | (CN) | 2008 2 0302131 |
| Sep. 16, 2008 | (CN) | 2008 2 0302140 |
| Sep. 16, 2008 | (CN) | 2008 2 0302141 |
| Sep. 30, 2008 | (CN) | 2008 2 0302301 |

(51) Int. Cl.
*H01R 13/66* (2006.01)

(52) U.S. Cl. ..... 439/620.15; 439/620.06; 439/620.07

(58) Field of Classification Search ..... 439/620.06, 439/620.07, 620.15, 941
See application file for complete search history.

(56) References Cited

U.S. PATENT DOCUMENTS

| | | | | |
|---|---|---|---|---|
| 5,926,003 | A * | 7/1999 | Morita | 320/107 |
| 7,241,181 | B2 * | 7/2007 | Machado et al. | 439/620.15 |
| 2007/0126542 | A1 * | 6/2007 | He et al. | 336/83 |

* cited by examiner

*Primary Examiner*—Tho D Ta
(74) *Attorney, Agent, or Firm*—Ming Chieh Chang; Wei Te Chung

(57) ABSTRACT

An electrical connector system includes a substrate (1) connected to PHY side and an electrical connector (3) mounted on the substrate (1), a transformer (5) and a common mode filter (7). The electrical connector (3) is used to mate with a cable assembly and so forms a Cable side. The transformer (5) further includes a first wire (51) having two opposite ends electrically connected to the PHY side and a second wire (53) having two opposite ends. The common mode filter (7) has a third wire (73) and a fourth wire (75) that are physically separated from the second wire (53). The third wire (73) has an end electrically connected to one end of the second wire (53) and an opposite end electrically connected to the Cable side. The fourth wire (75) has an end electrically connected to the opposite end of the second wire (53) and an opposite end electrically connected to the Cable side.

19 Claims, 35 Drawing Sheets

ELECTRICAL CONNECTOR SYSTEM WITH MAGNETIC MODULE

CROSS-REFERENCE TO RELATED APPLICATIONS

This patent application is related to a pending U.S. patent application Ser. No. 12/319,299, filed on Jan. 5, 2008, published in Document No. 2009 0176408 A1 on Jul. 9, 2009, and entitled "ELECTRICAL CONNECTOR HAVING AN IMPROVED MAGNETIC MODULE", which is assigned to the same assignee with this application. This patent application is also related to two pending U.S. patent application Ser. Nos. 12/321,470 and 12/508,792, which are assigned to the same assignee with this application.

BACKGROUND OF THE INVENTION

1. Field of the Invention

The present invention relates to an electrical connector system, and more particularly, to an electrical connector system having magnetic module for noise-filter.

2. Description of the Prior Art

Magnetic elements, including transformer and common mode filter, are often used in noise-filter in the high frequency field. An electrical connector system having magnetic modules with more effective noise filtering, smaller size and lower cost is always a focus of the designers of the field.

OBJECTS OF THE INVENTION

A main object of the present invention is to provide an electrical connector system having transformer and common mode filter which is convenient to be manufactured and assembled.

The present invention provides an electrical connector system used for a network interface, said network interface providing signal channels between a first side and a second side. The electrical connector system comprising a substrate forming a plurality of conductive traces, an electrical connector mounted on the substrate; a transformer having a first wire having two opposite ends electrically connected to said first side and a second wire having two opposite ends, a common mode filter having a third wire and a fourth wire that are physically separated from the second wire, wherein the third wire has an end electrically connected to one end of the second wire and an opposite end electrical connected to said second side, and wherein the fourth wire has an end electrically connected to the opposite end of the second wire and an opposite end electrical connected to said second side. The transformer is incorporated into a plastic container, the plastic container having a plurality of conductive tails electrically connected to opposite ends of the first and the second wires The second wire and the third wire and the fourth wire are physically separated from each other, so that the transformer and the common mode filter could be independently manufactured and conveniently assembled.

BRIEF DESCRIPTION OF THE DRAWINGS

The features of this invention, which are believed to be novel, are set fourth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
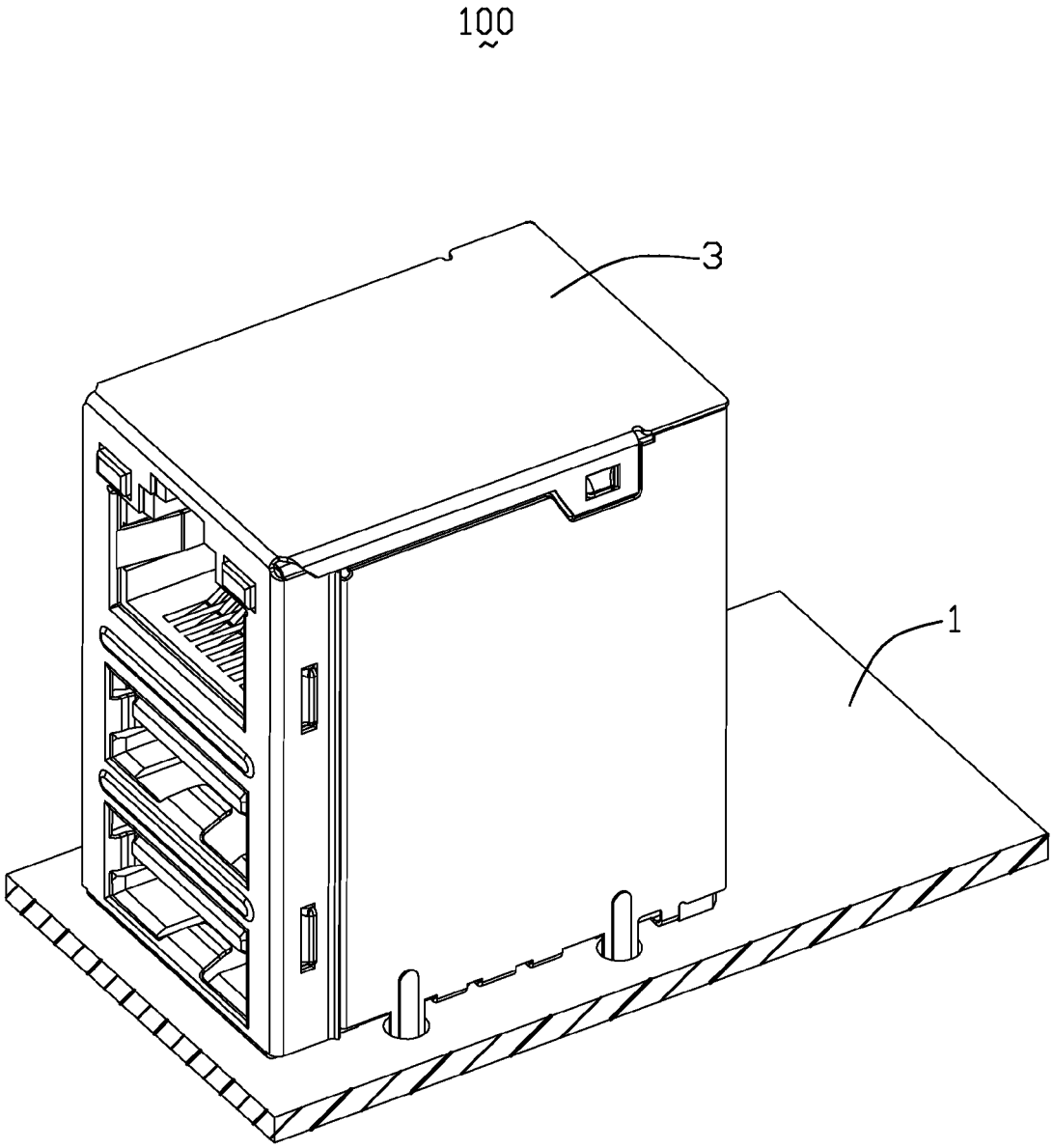
FIG. 1 is a perspective view of an electrical connector system of according to a prior design.
Figure 2:
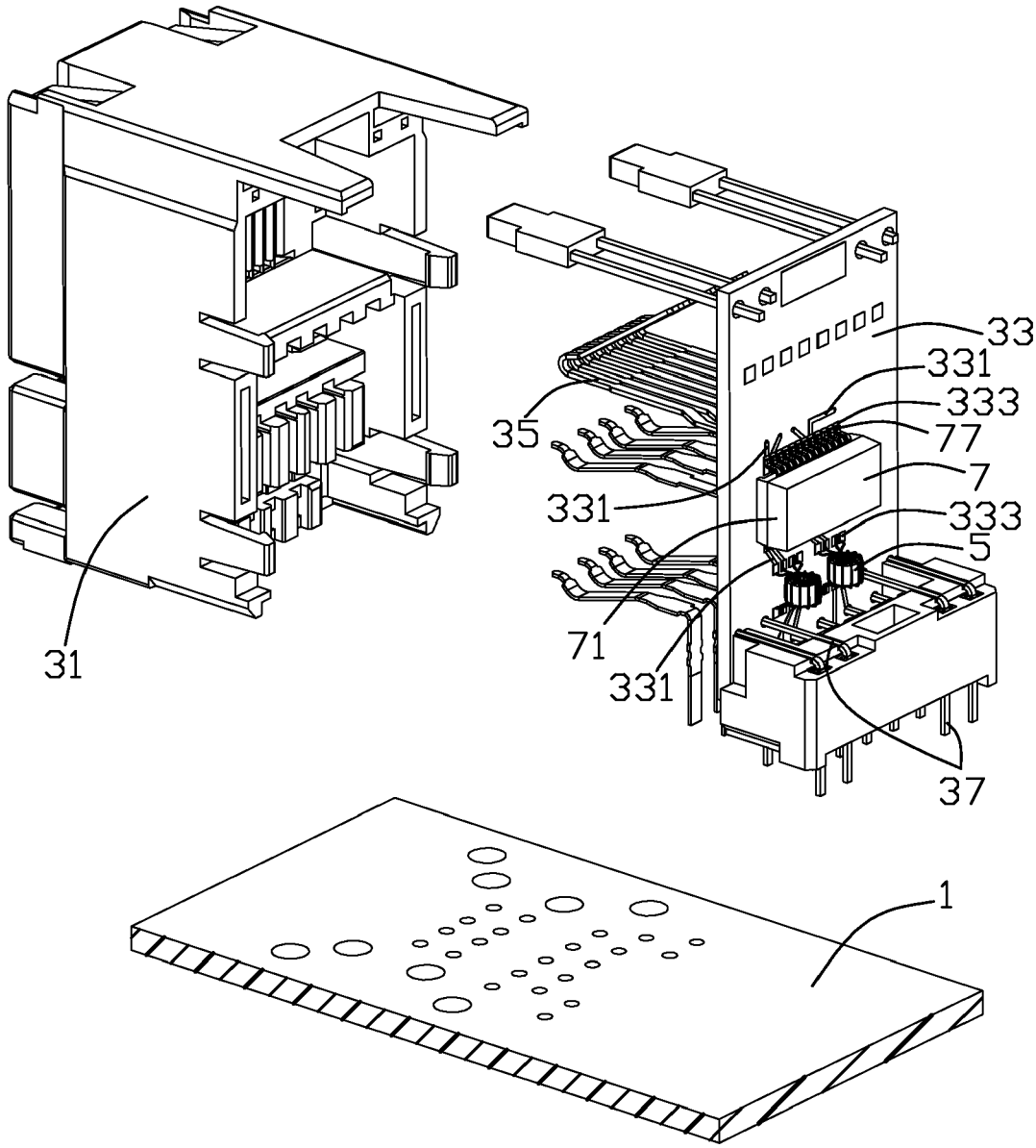
FIG. 2 is an exploded view of the electrical connector system shown in FIG. 1.
Figure 3:
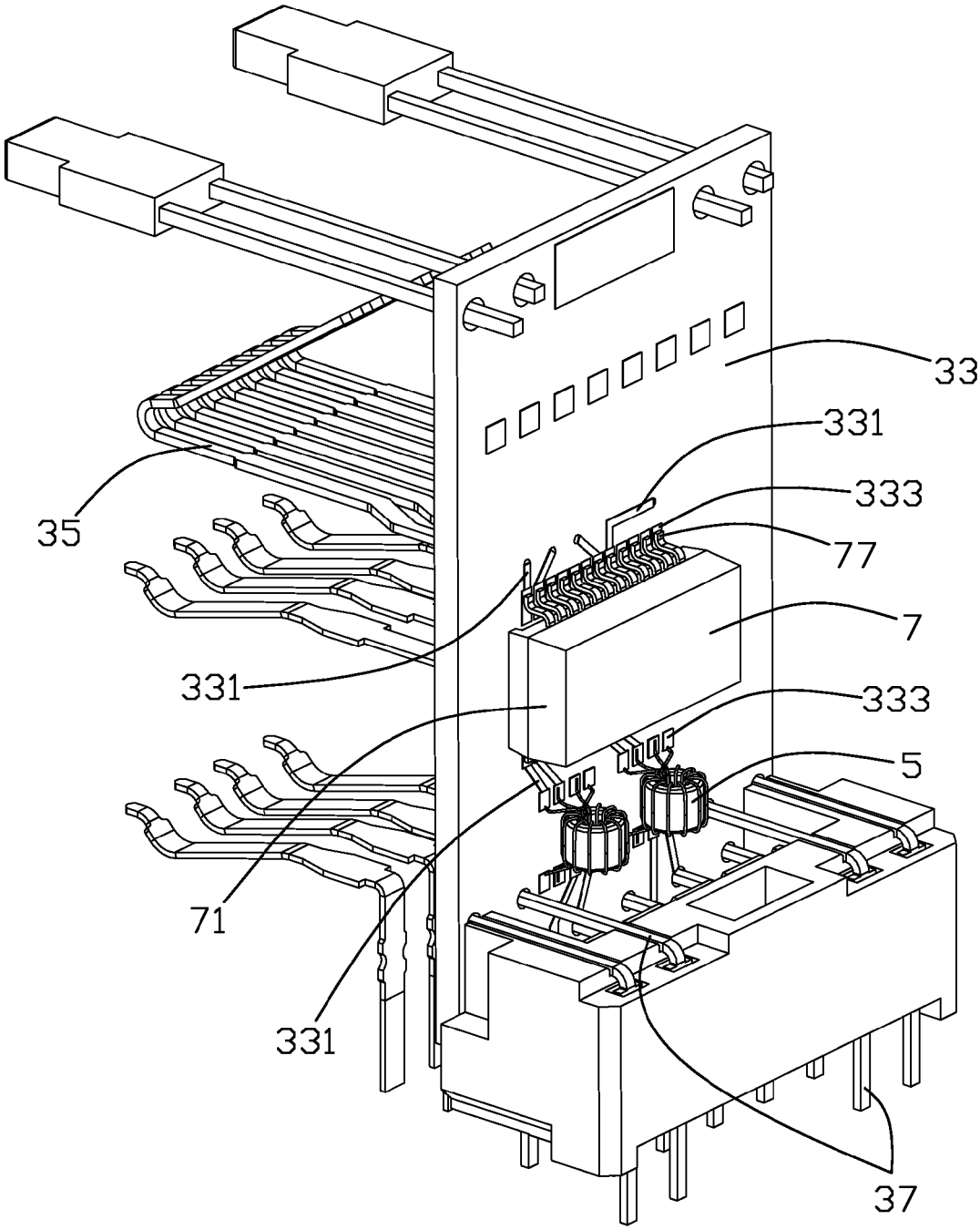
FIG. 3 is a perspective view of a filter portion shown in FIG. 2.

Reference will now be made to the drawing figures to describe the present invention in detail.

FIGS. 1-12D show prior designs disclosed four electrical connector systems embodying similar principle to the present invention. The electrical connector systems are used for a network interface for 10/100 based Ethernet. The network interface provides signal channels (referring to FIGS. 12A-12D) between a PHY side and a Cable side.

Referring to FIGS. 1-3 and 12A-12C, the electrical connector system comprises a substrate 1 forming a plurality of conductive traces connected to PHY side, an electrical connector 3 mounted on the substrate 1, two transformers 5, and a common mode filter module 7. The electrical connector 3 is used to mate with a cable assembly and so forms a Cable side. The transformer 5 further comprises a first wire 51 having two opposite ends electrically connected to the PHY side and a second wire 53 having two opposite ends. The common mode filter module 7 comprises two common mode filters. Each common mode filter has a third wire 73 and a fourth wire 75 that are physically separated from the second wire 53. The third wire 73 has an end electrically connected to one end of the second wire 53 and an opposite end electrically connected to the Cable side. The fourth wire 75 has an end electrically connected to the opposite end of the second wire 53 and an opposite end electrically connected to the Cable side.

The common mode filter 7 further comprises a plastic container 71, two magnetic cores received in the plastic container 71 and a plurality of conductive tails 77 molded together with the plastic container 71. The third wires 73 and the fourth wires 75 wind around the magnetic cores. The ends of the third and the fourth wires 73, 75 are respectively electrically connected to said conductive tails 77. So, the container 71 makes the common mode filter 7 an integrated common mode module that can be assembled conveniently.

The transformer 5 further comprises a ringy magnetic core and said first and said second wires 51, 53 are wound around the ringy magnetic core.

Figure 12A:
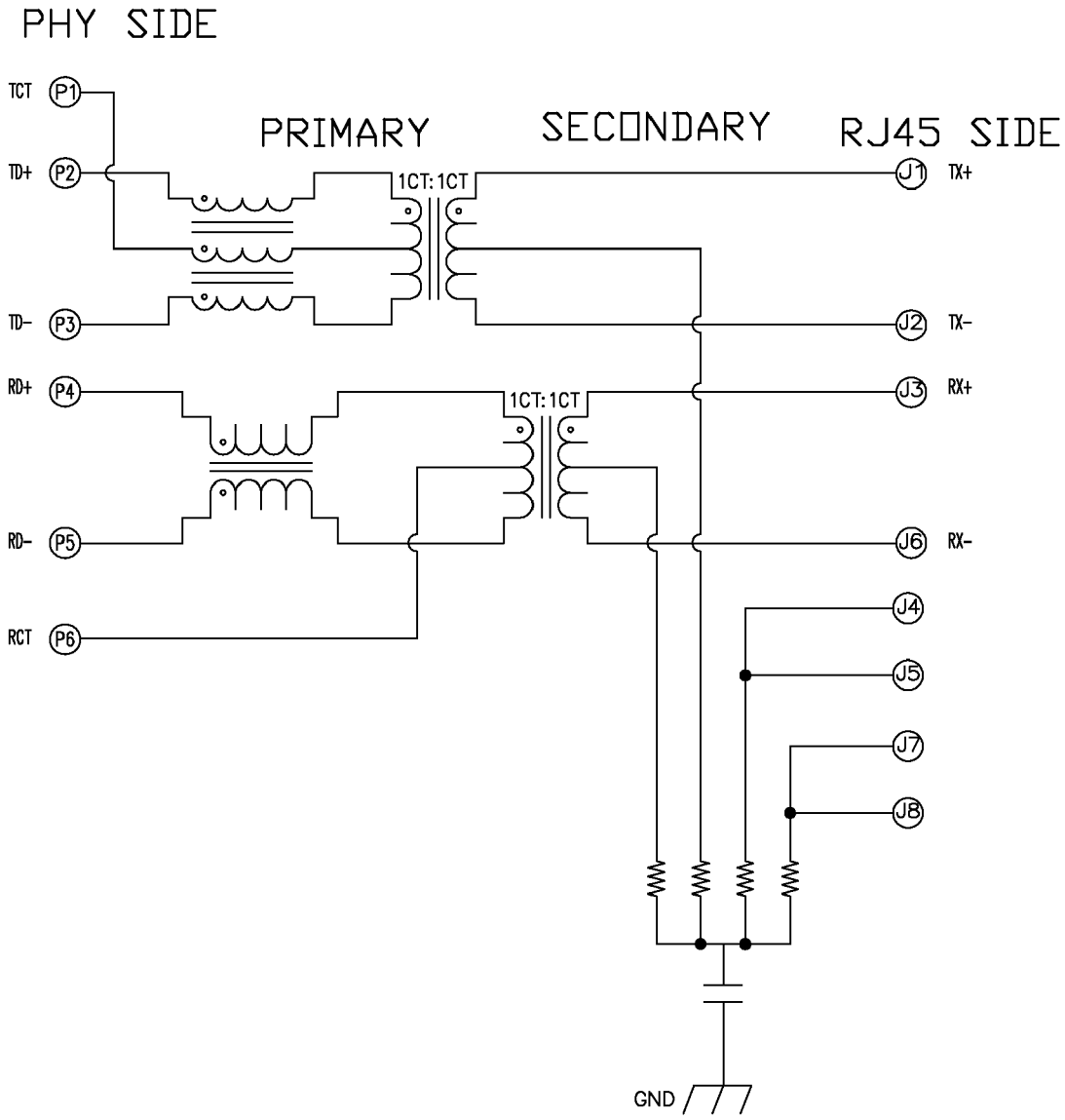
FIG. 12(*a*)-12(*d*) are circuit diagrams according to present invention.
Figure 12B:
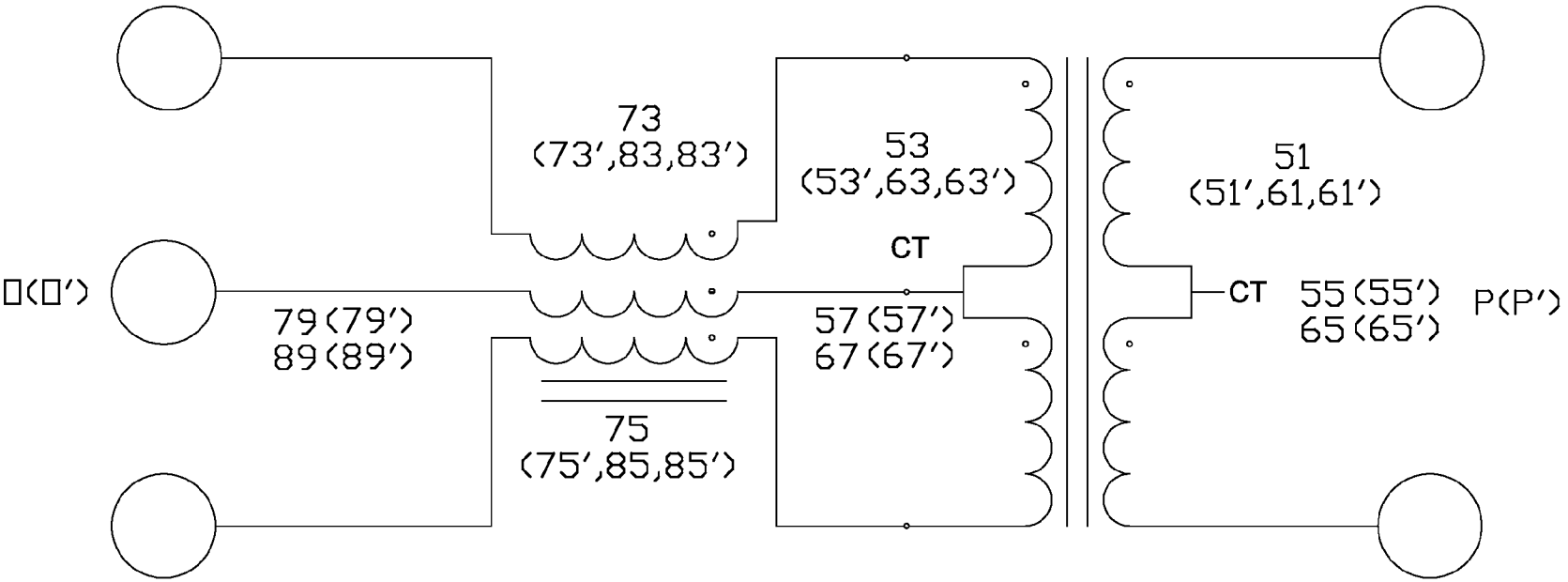
Figure 12C:
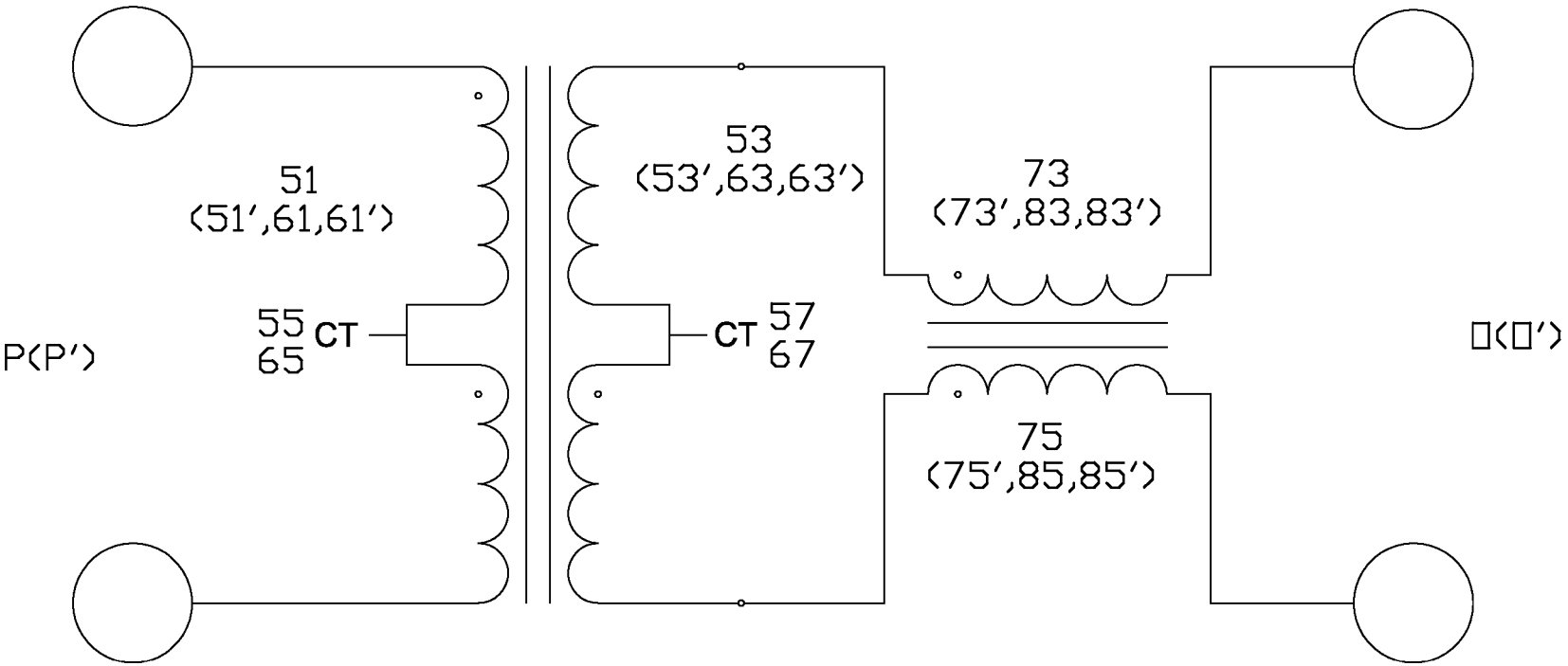

Referring to FIGS. 12A-12C, circuit diagrams of the network interface are provided. It is shown that each of said first and said second wires 51, 53 forms a center tap 55, 57. In one optional design, the center tap 55 of the first wire 51 is connected to ground, while the common mode module 7 further comprise a fifth wire 79 winding the magnetic core, the center tap 57 of the second wire 53 being electrically connected to ground through the fifth wire 79, which is shown in FIG. 12B. In another optional design, the fifth wire 79 is not provided and the center tap 57 of the second wire is electrically connected to ground directly, which is shown in FIG. 12C. It is the same for other prior designs of that center taps and a fifth wire may be optionally used to further improve noise filter.

Referring back to FIGS. 2 and 3, the electrical connector 3 further comprises an interior PCB 33, a plurality of mating contacts 35 and a plurality of transferring contacts 37 mounted on the interior PCB. The transformer 5 and the common mode module 7 are mounted on the interior PCB 33. The interior PCB 33 forms a plurality of conductive traces 331 and a plurality of conductive pads 333. The opposite ends of the first wire 51 are electrically connected to the PHY side through some of the conductive traces 331 of the interior PCB 33 and said transferring contacts 37. The opposite ends of the second wire 53 are respectively electrically connected to ends of the third and the fourth wires 73, 75 sequentially through some of the conductive pads 333, some of the conductive trace 331 of the interior PCB 33, some other conductive pads 333, some of the conductive tails 77 and some other of the conductive pads 333. The opposite ends of the third and the fourth wires 73, 75 are electrically connected to the Cable side sequentially through some other of the conductive tails 77, some of the conductive traces 331 of the interior PCB 33 and the mating contacts 35.

Figure 12D:
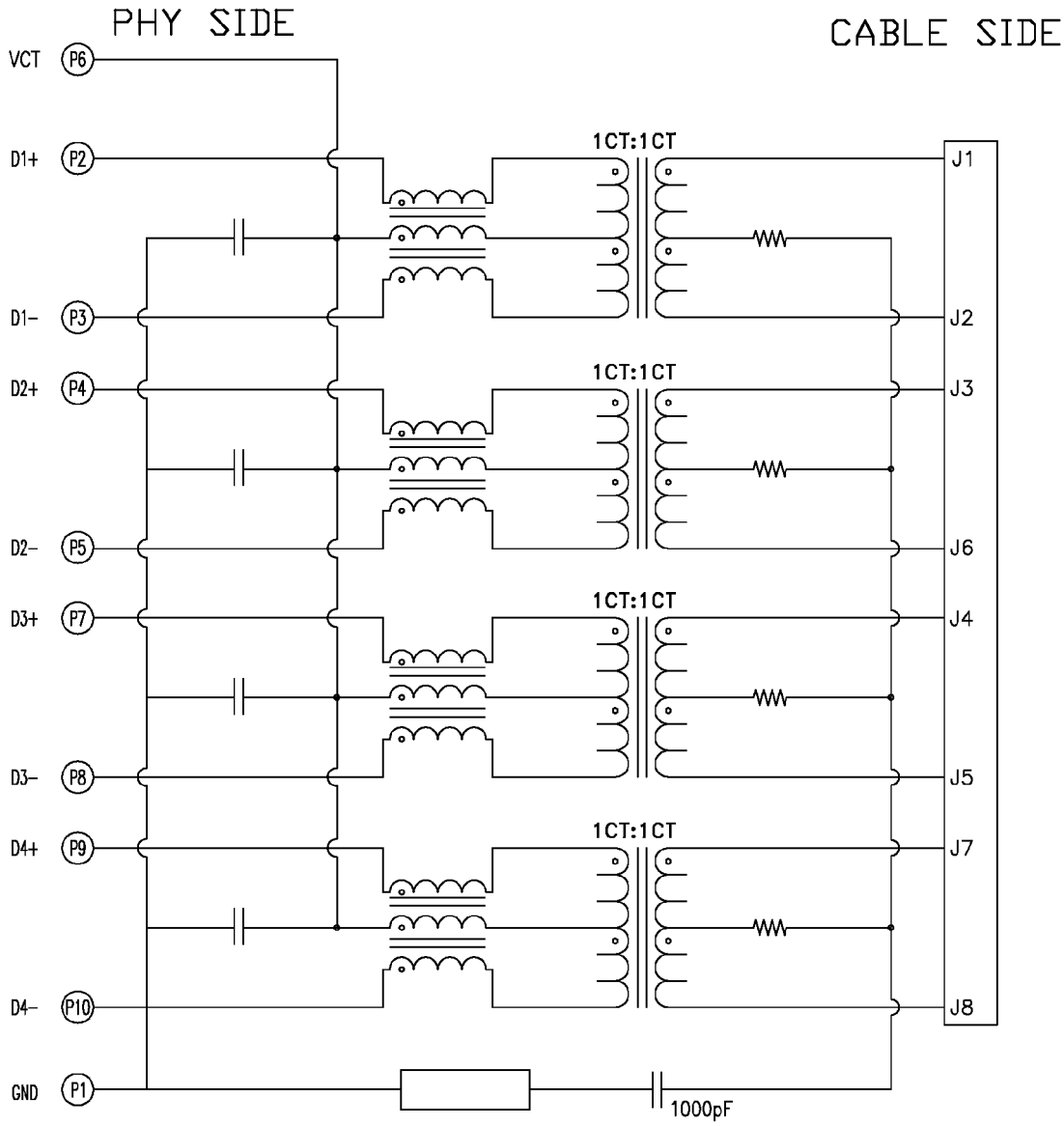
Figure 13:
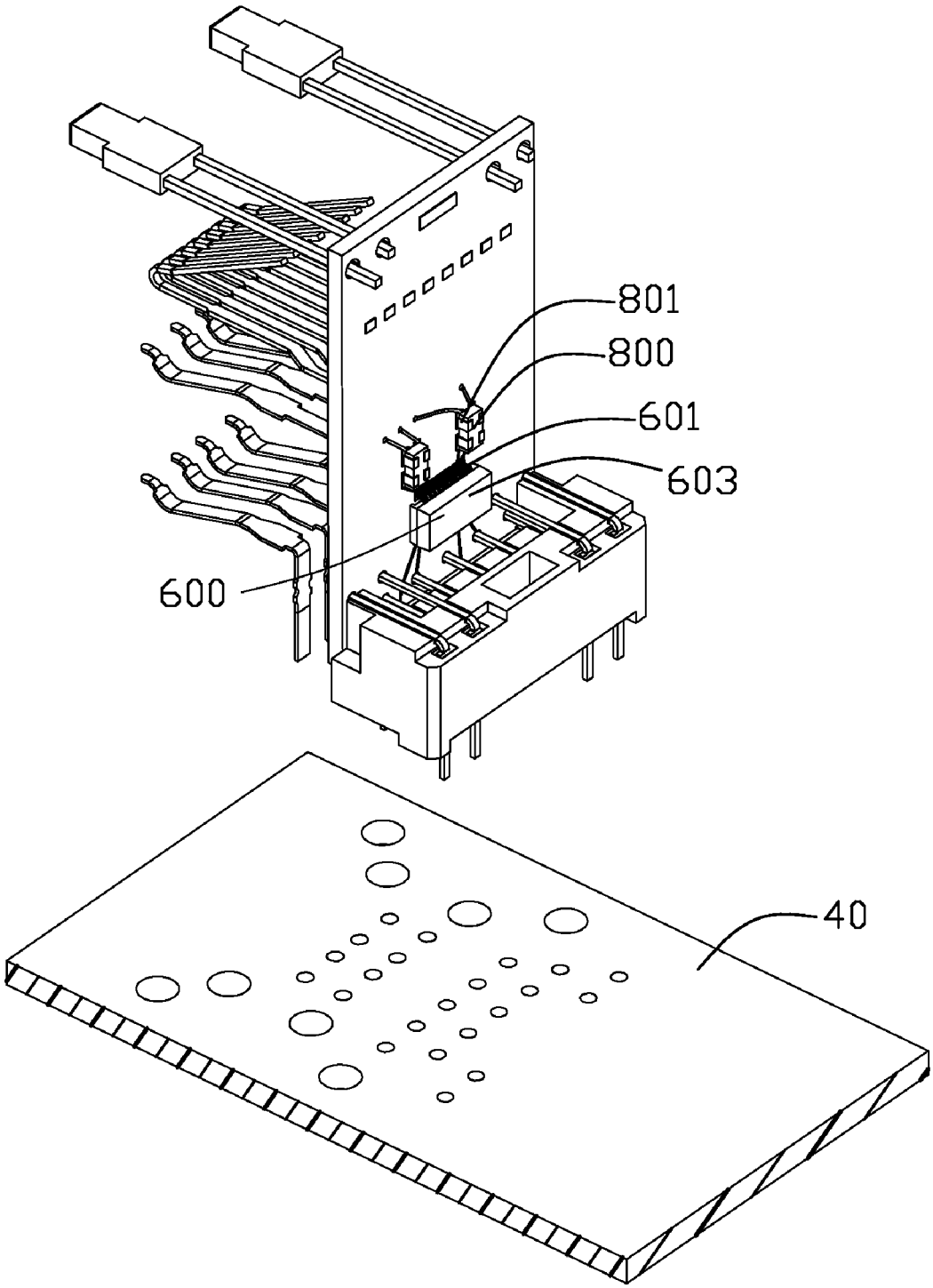
FIG. 13 is a perspective view of a filter portion according to a first embodiment of the present invention.
Figure 14:
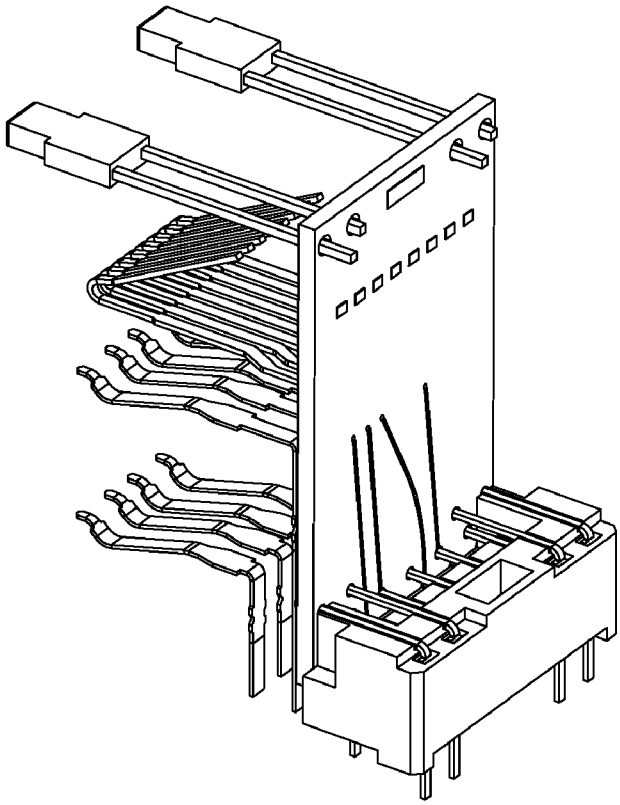
FIG. 14 is a perspective view of a filter portion according to a second embodiment of the present invention.
Figure 14:
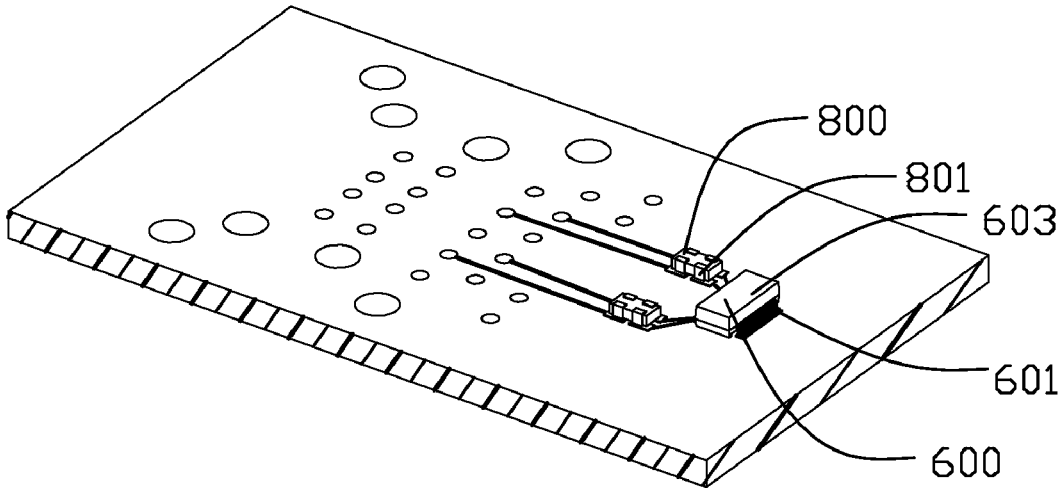
Figure 15:
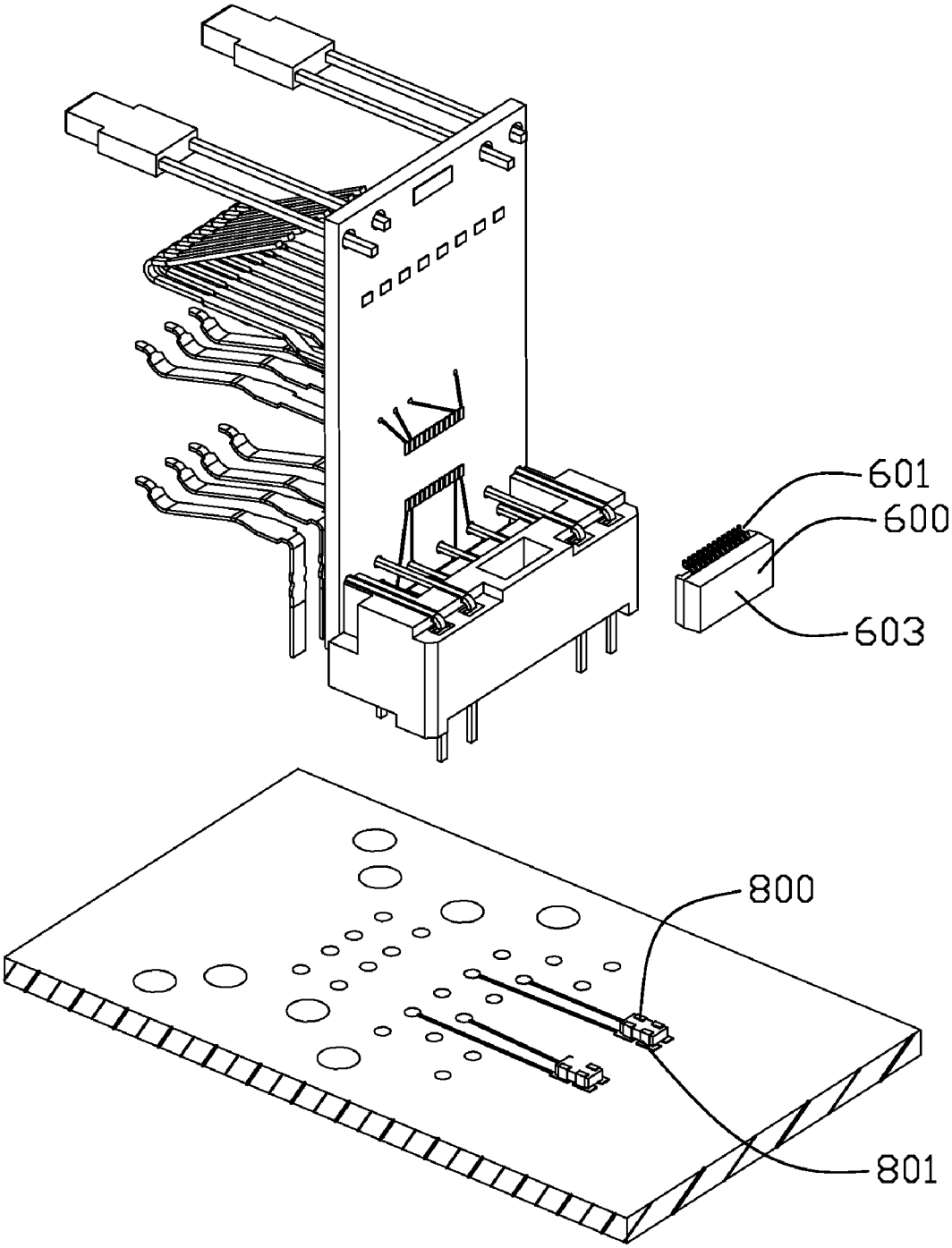
FIG. 15 is a perspective view of a filter portion according to a third embodiment of the present invention.
Figure 16:
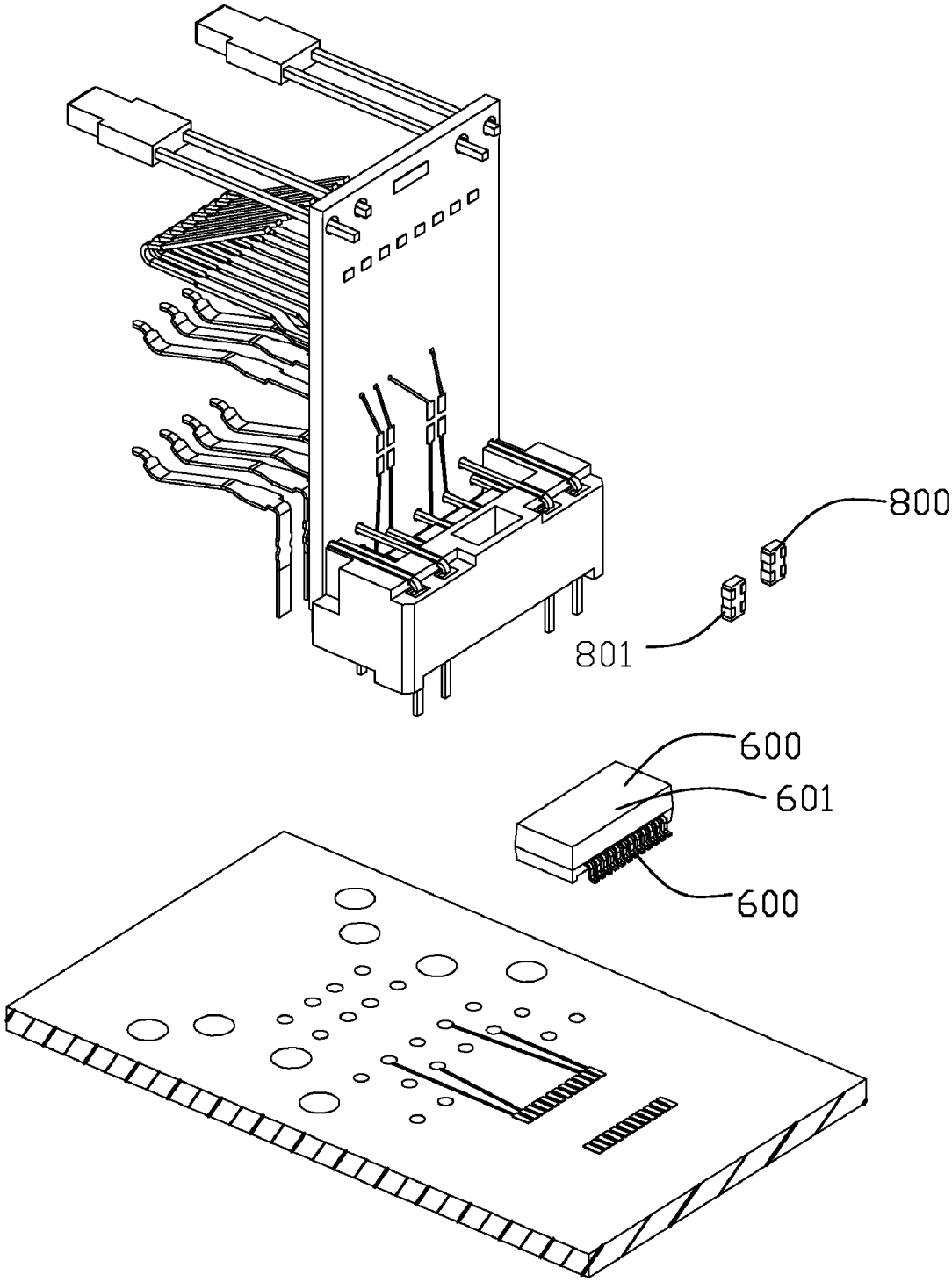
FIG. 16 is a perspective view of a filter portion according to a fourth embodiment of the present invention.
Figure 17:
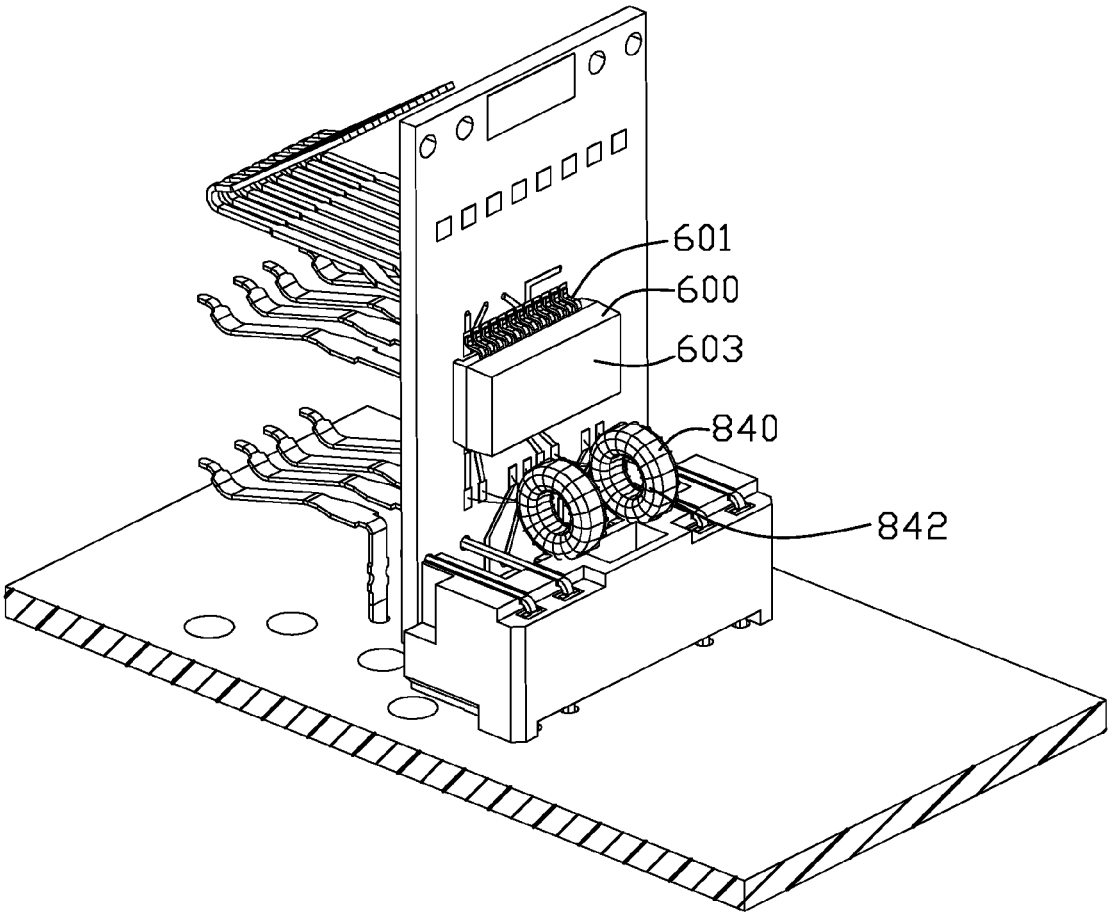
FIG. 17 is a perspective view of a filter portion according to a fifth embodiment of the present invention.
Figure 18:
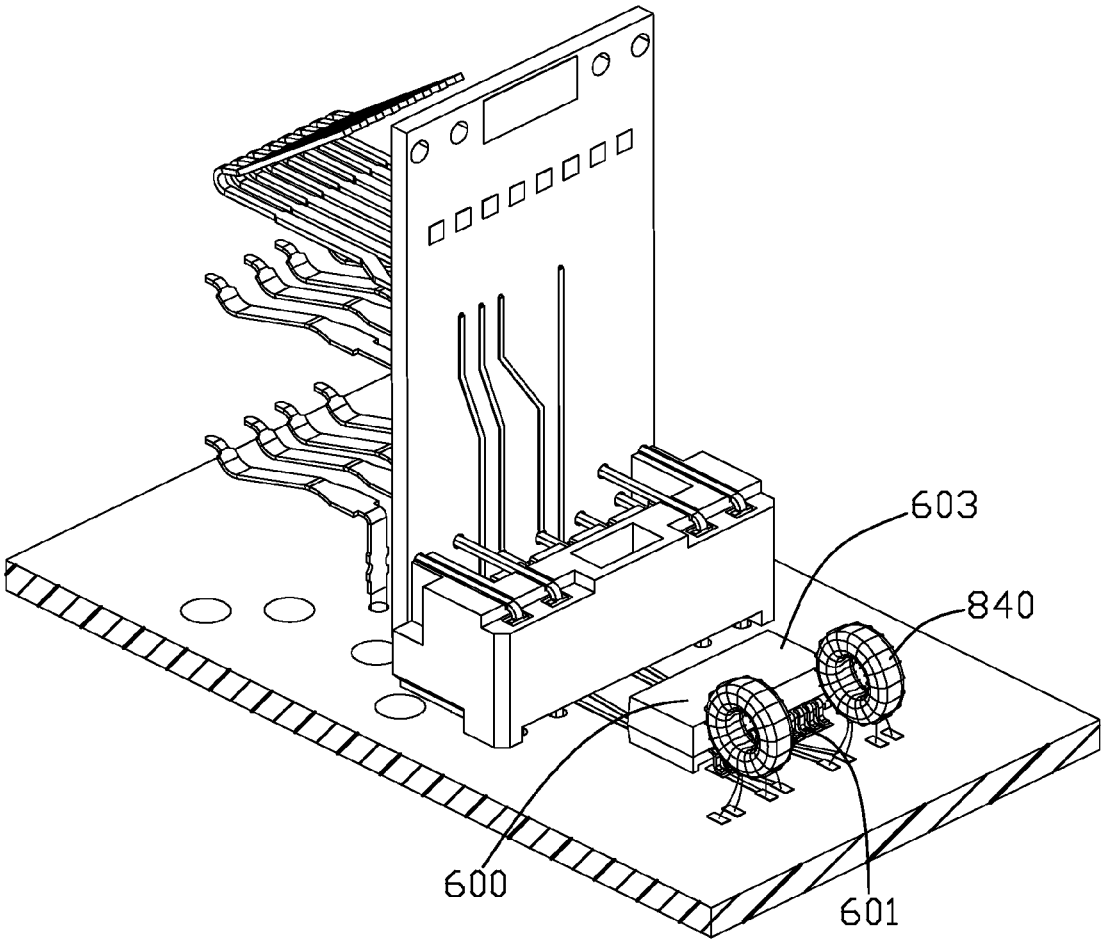
FIG. 18 is a perspective view of a filter portion according to a sixth embodiment of the present invention.
Figure 19:
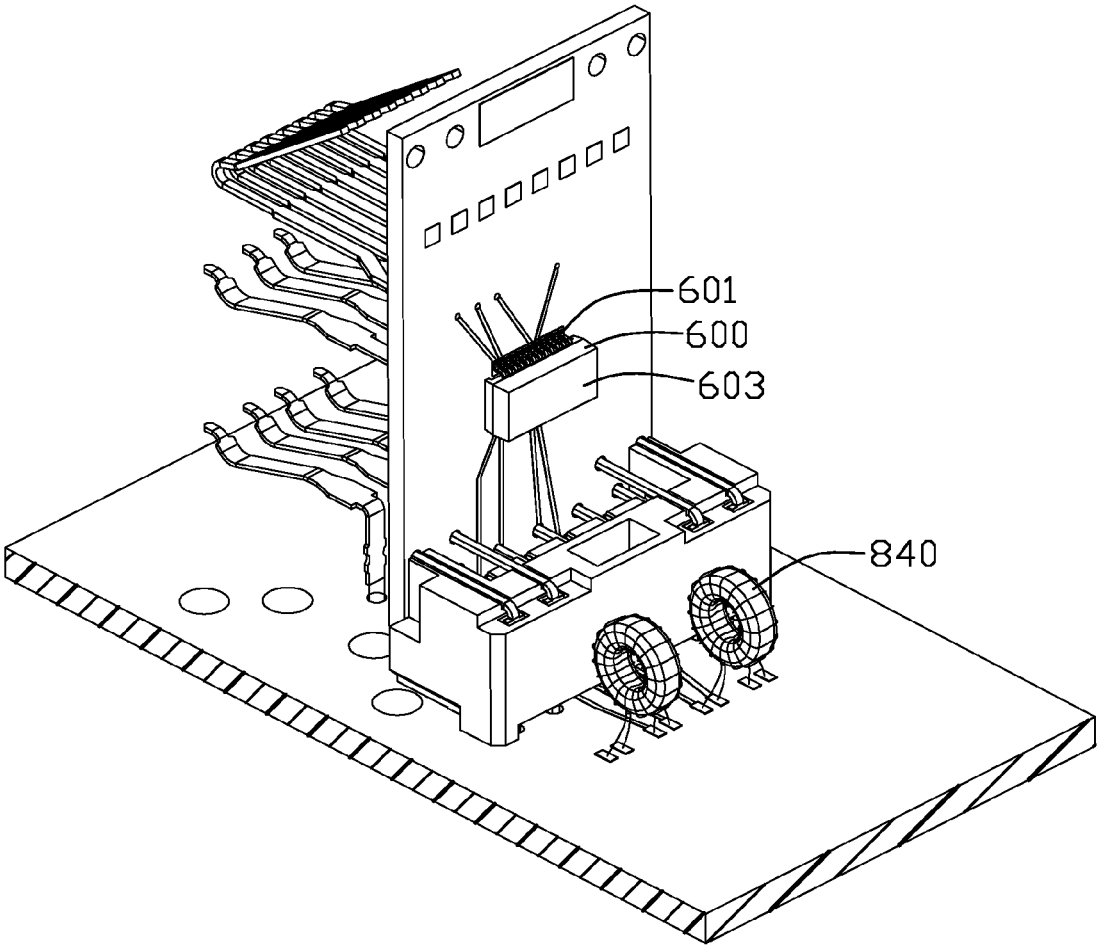
FIG. 19 is a perspective view of a filter portion according to a seventh embodiment of the present invention.
Figure 20:
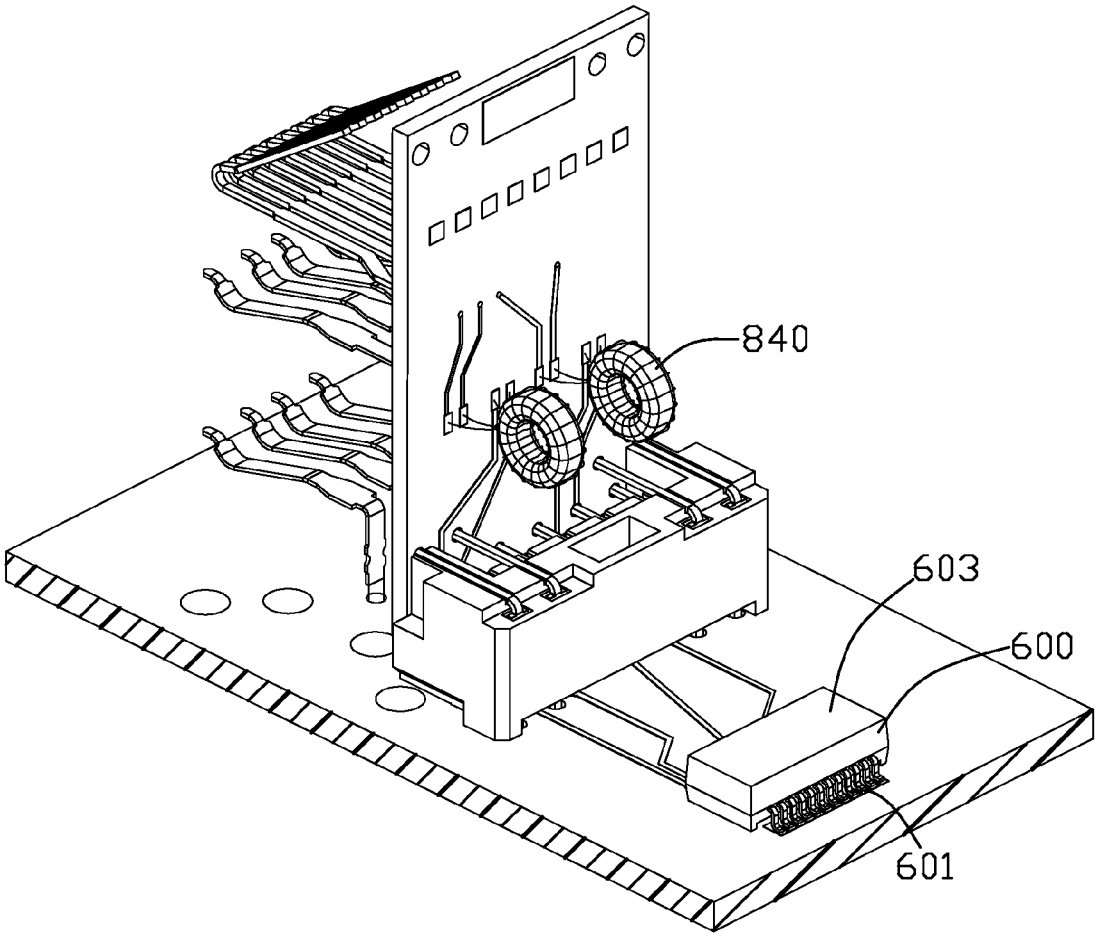
FIG. 20 is a perspective view of a filter portion according to an eighth embodiment of the present invention.
Figure 21:
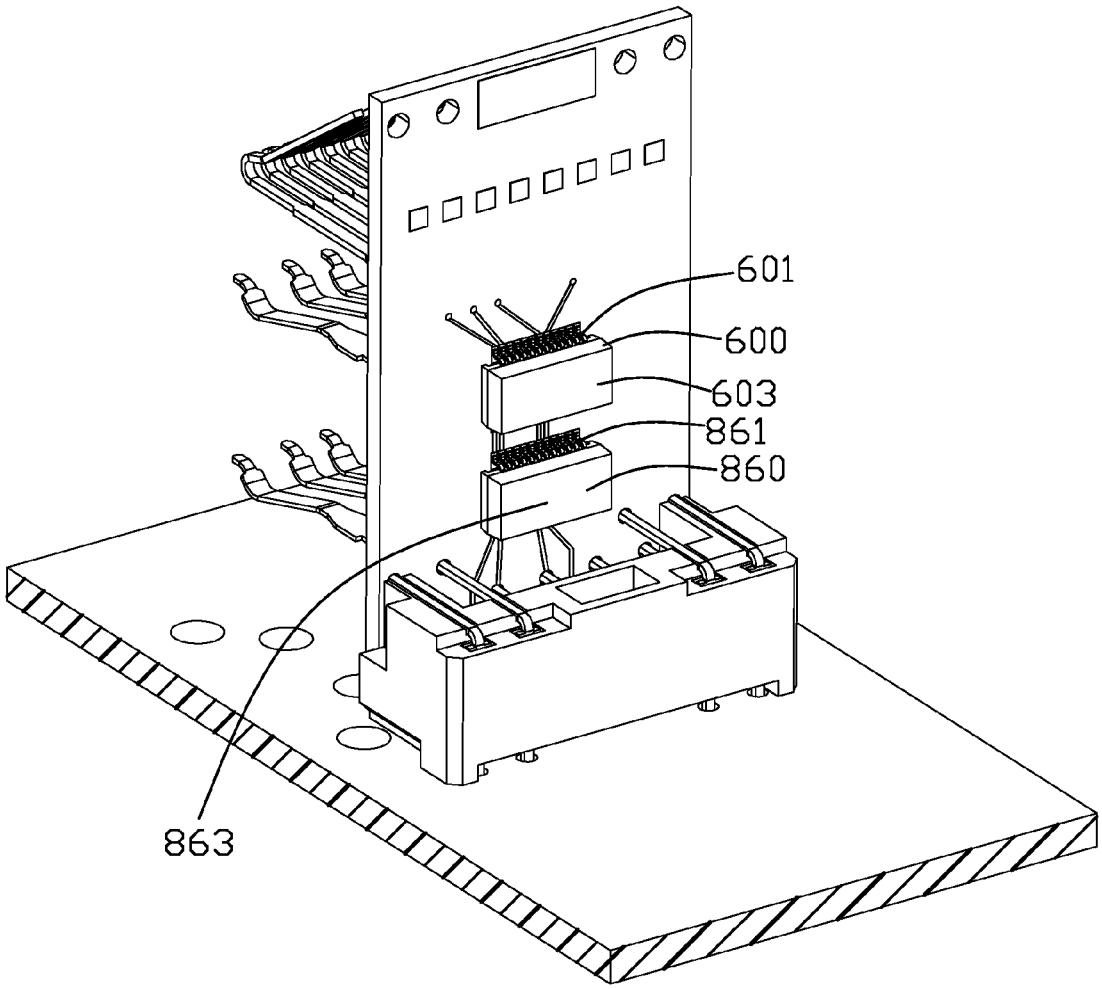
FIG. 21 is a perspective view of a filter portion according to a ninth embodiment of the present invention.
Figure 22:
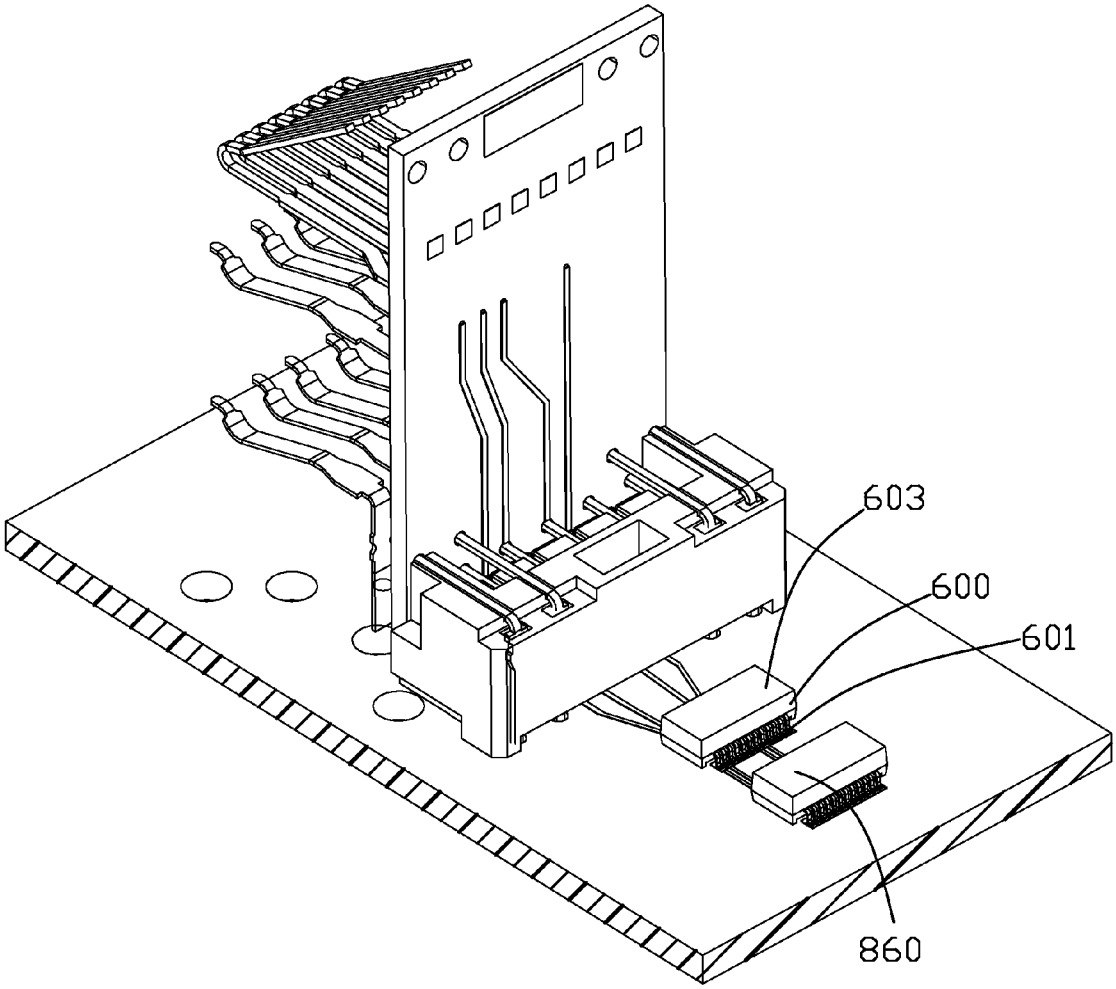
FIG. 22 is a perspective view of a filter portion according to a tenth embodiment of the present invention.
Figure 23:
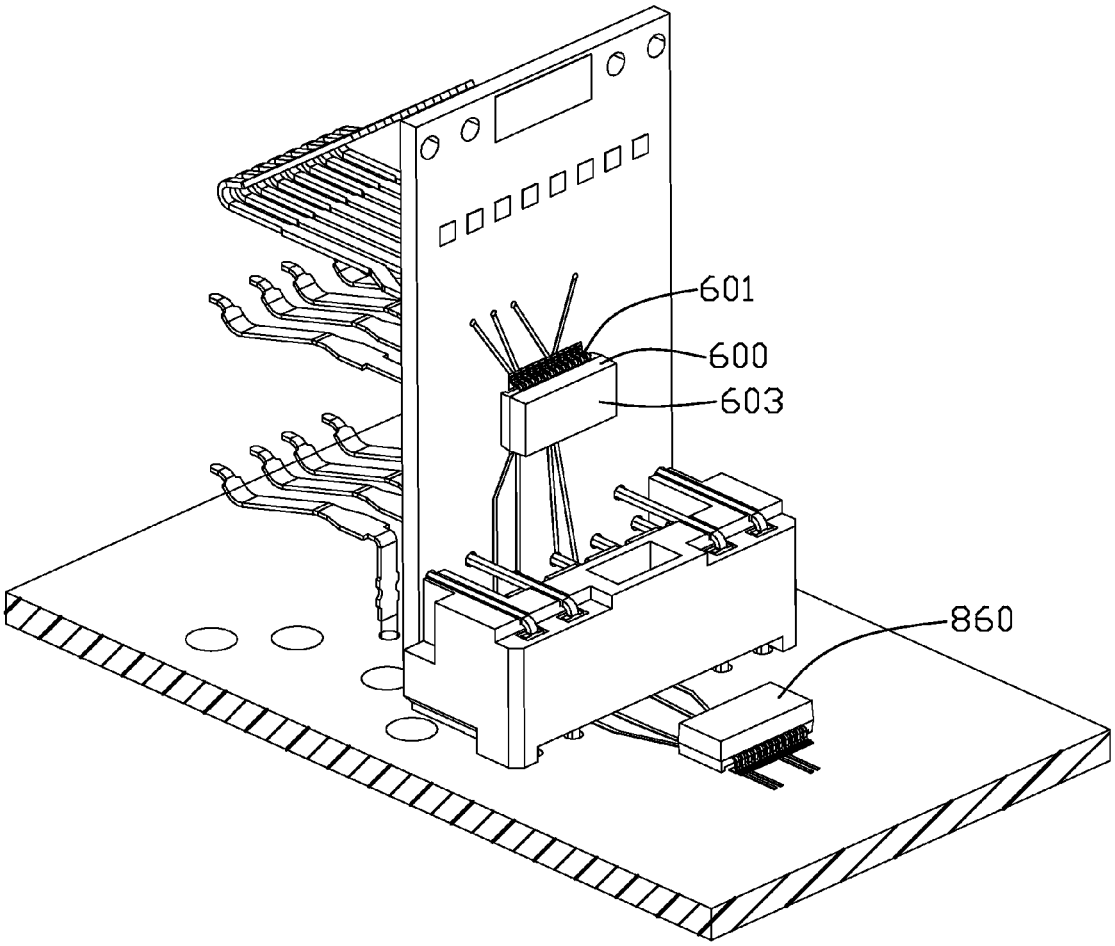
FIG. 23 is a perspective view of a filter portion according to a eleventh embodiment of the present invention.
Figure 24:
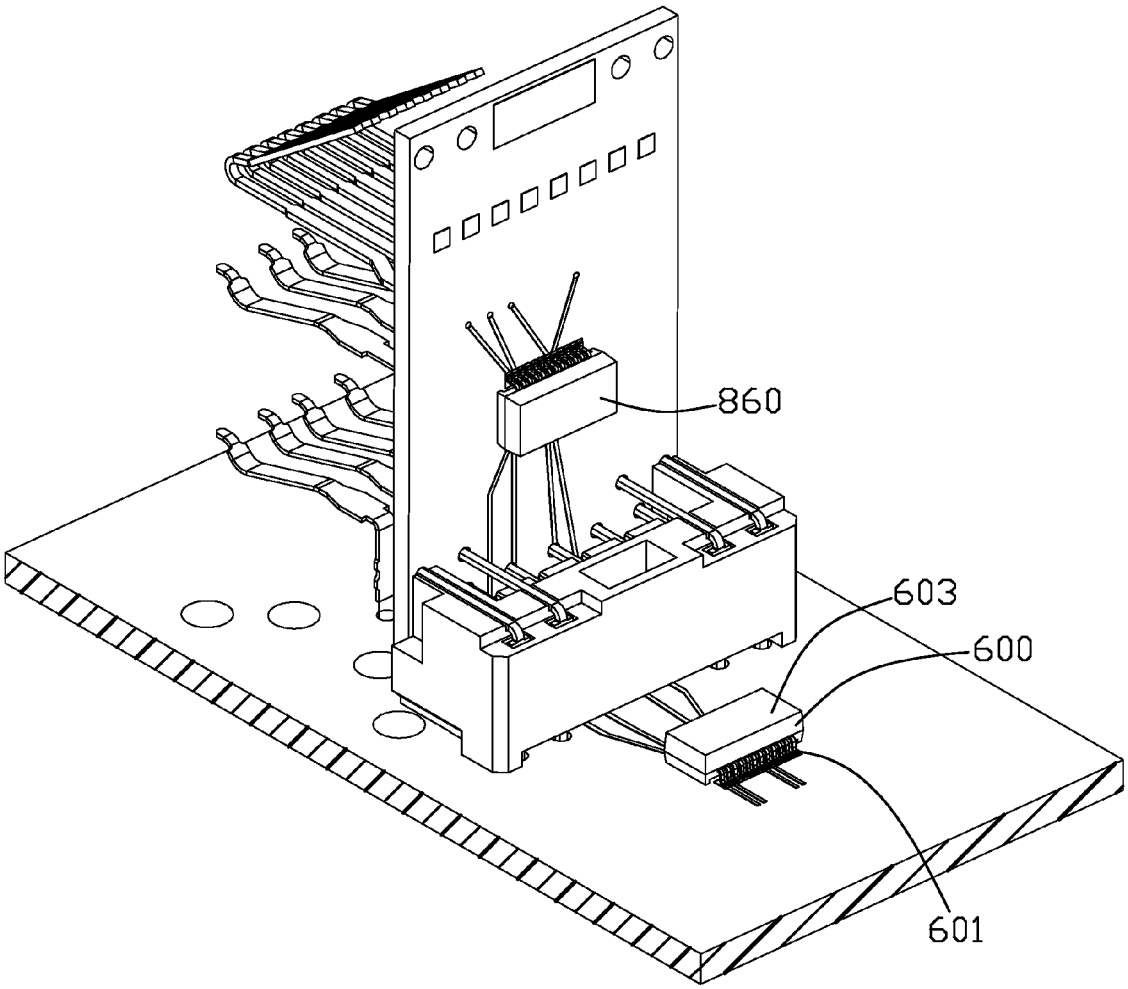
FIG. 24 is a perspective view of a filter portion according to a twelfth embodiment of the present invention.
Figure 25:
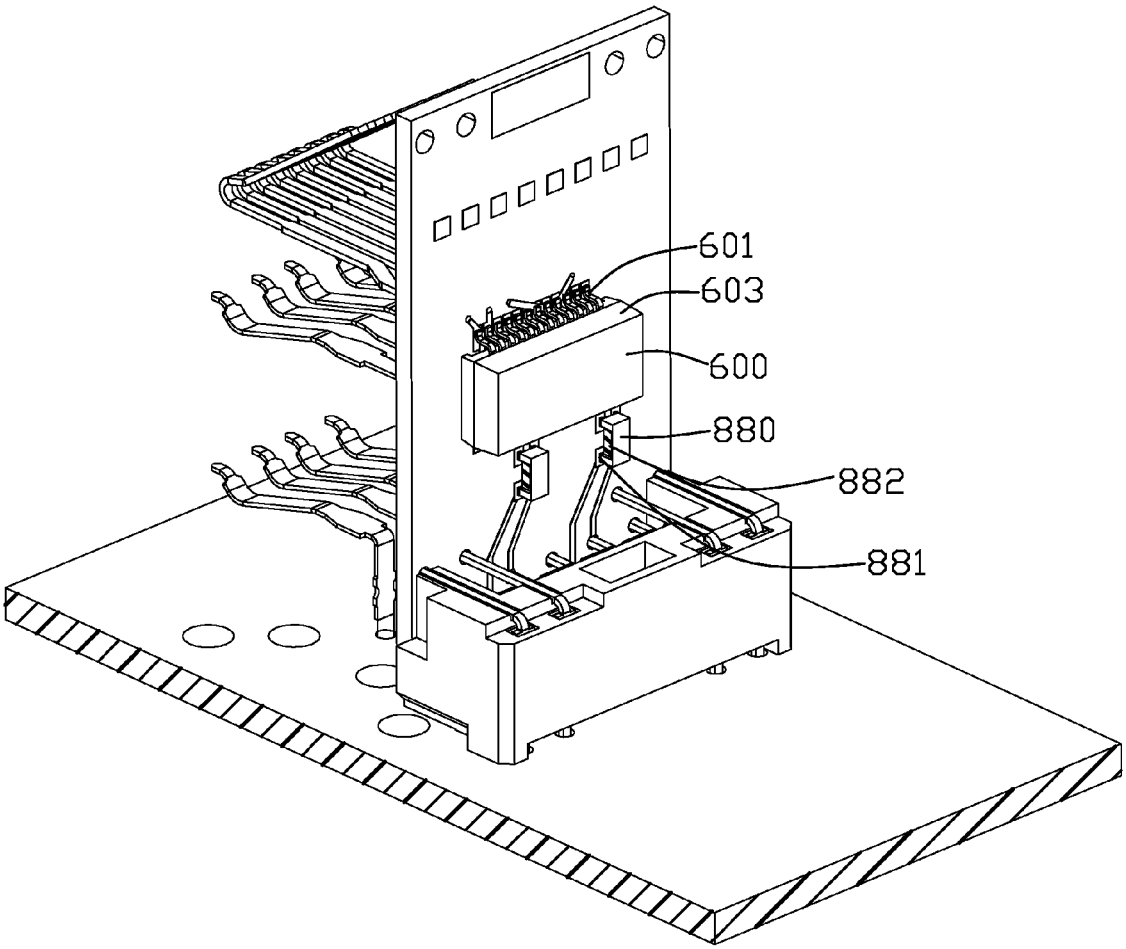
FIG. 25 is a perspective view of a filter portion according to a thirteenth embodiment of the present invention.
Figure 26:
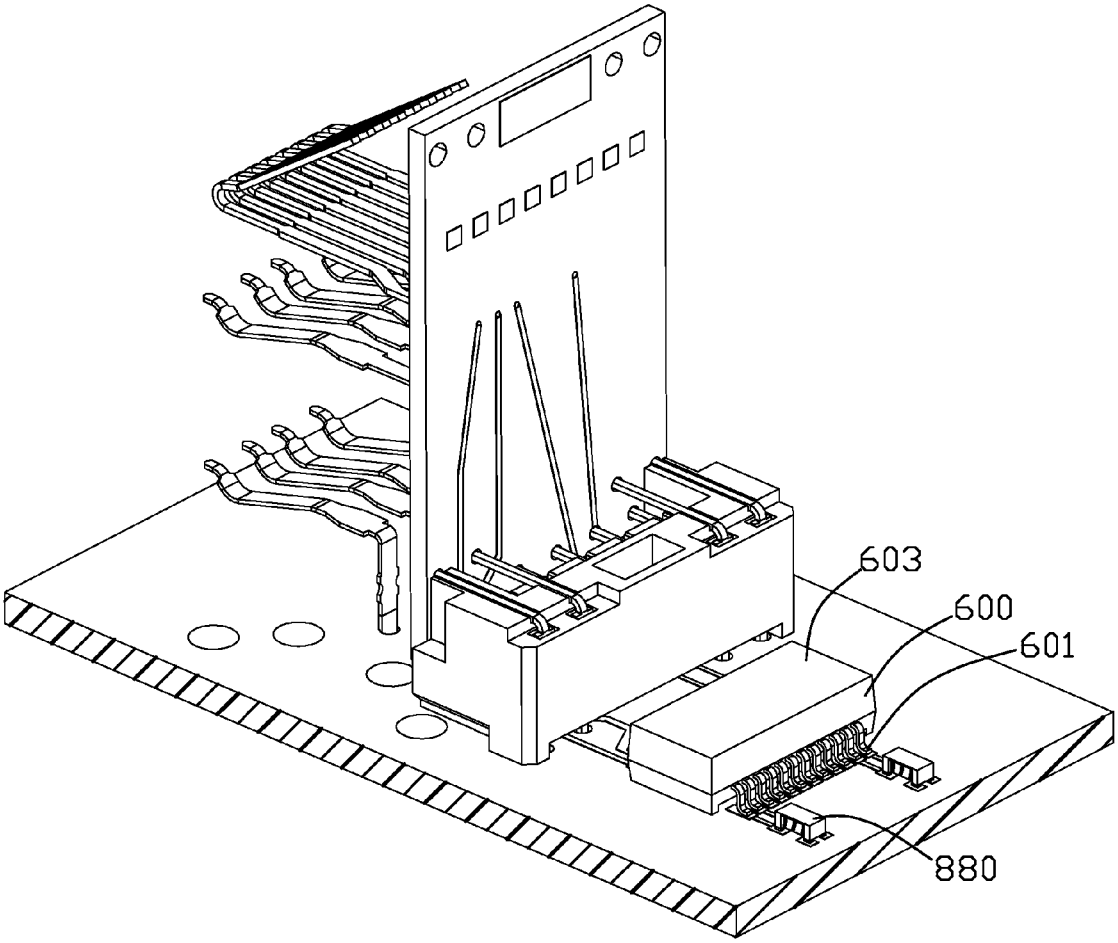
FIG. 26 is a perspective view of a filter portion according to a fourteenth embodiment of the present invention.
Figure 27:
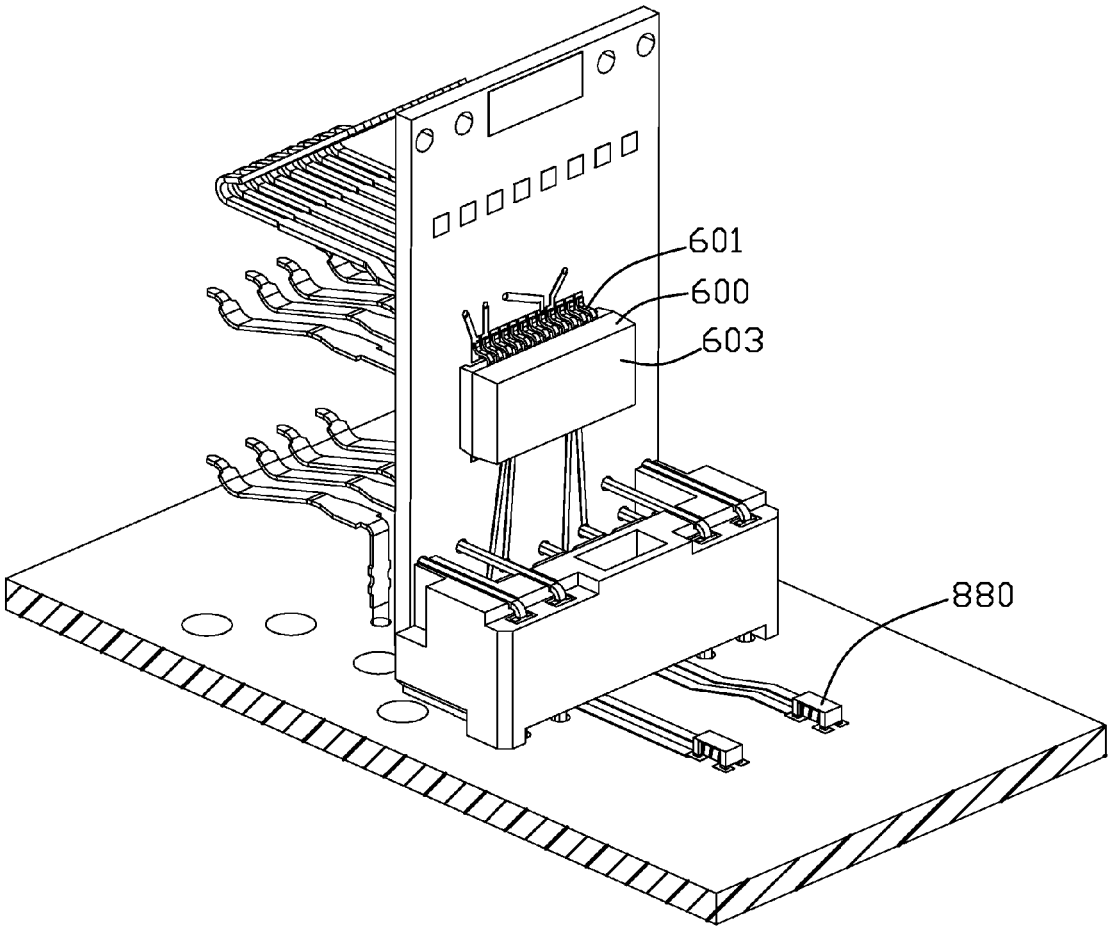
FIG. 27 is a perspective view of a filter portion according to a fifteenth embodiment of the present invention.
Figure 28:
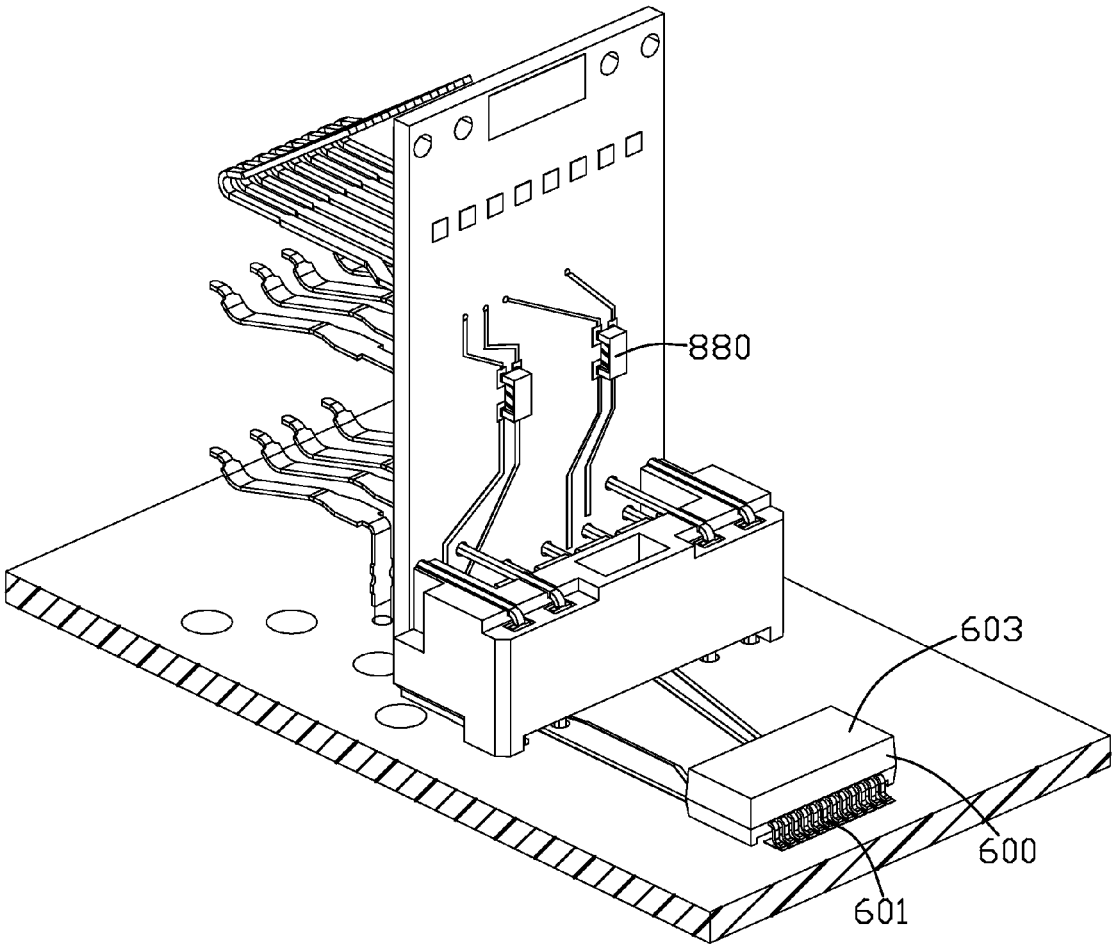
FIG. 28 is a perspective view of a filter portion according to a sixteenth embodiment of the present invention.
Figure 29:
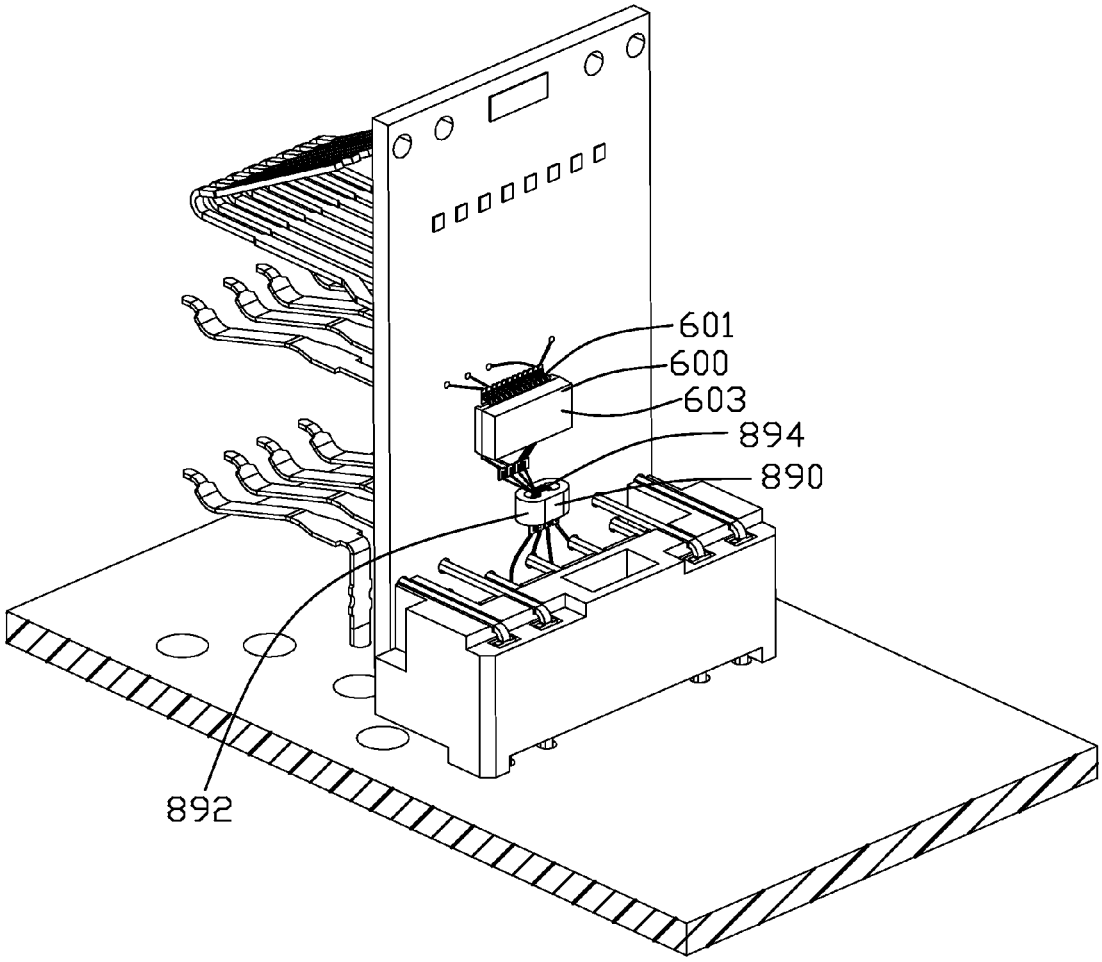
FIG. 29 is a perspective view of a filter portion according to a seventeenth embodiment of the present invention.
Figure 30:
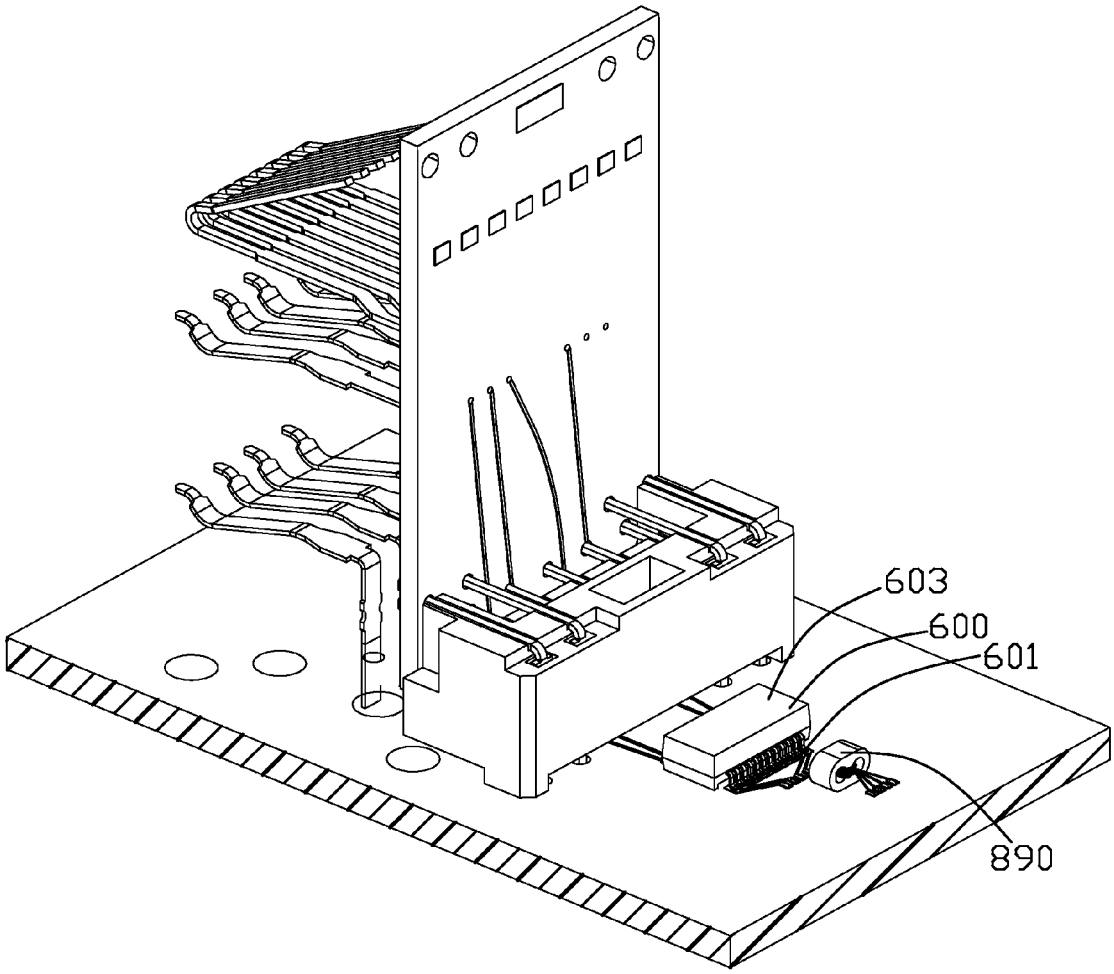
FIG. 30 is a perspective view of a filter portion according to an eighteenth embodiment of the present invention.
Figure 31:
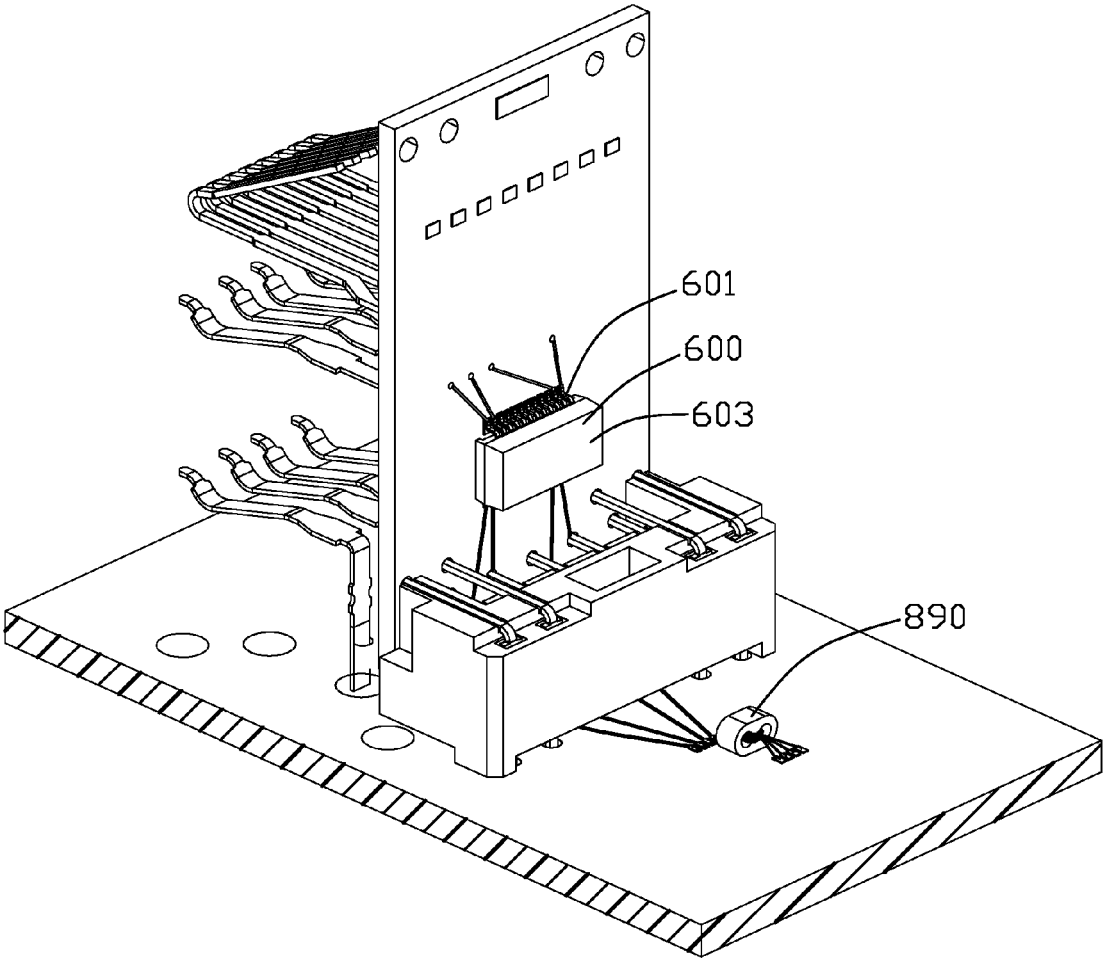
FIG. 31 is a perspective view of a filter portion according to a nineteenth embodiment of the present invention.
Figure 32:
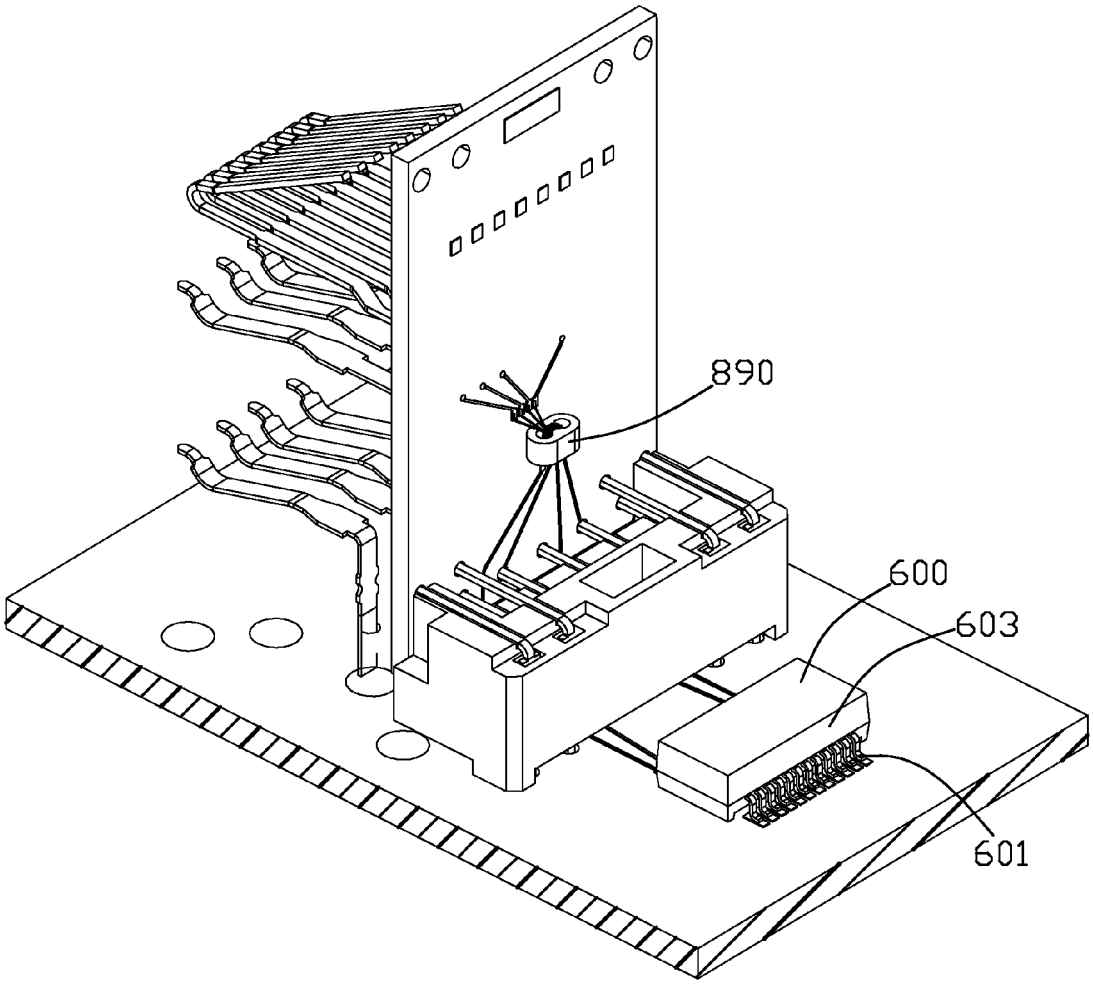
FIG. 32 is a perspective view of a filter portion according to a twentieth embodiment of the present invention.

Referring to FIG. 12D, circuit diagram of an electrical connector system in 10-1000 based Ethernet application is shown, which is similar to the circuit diagram of 10/100 based Ethernet application except that there are four signal channels.

Figure 4:
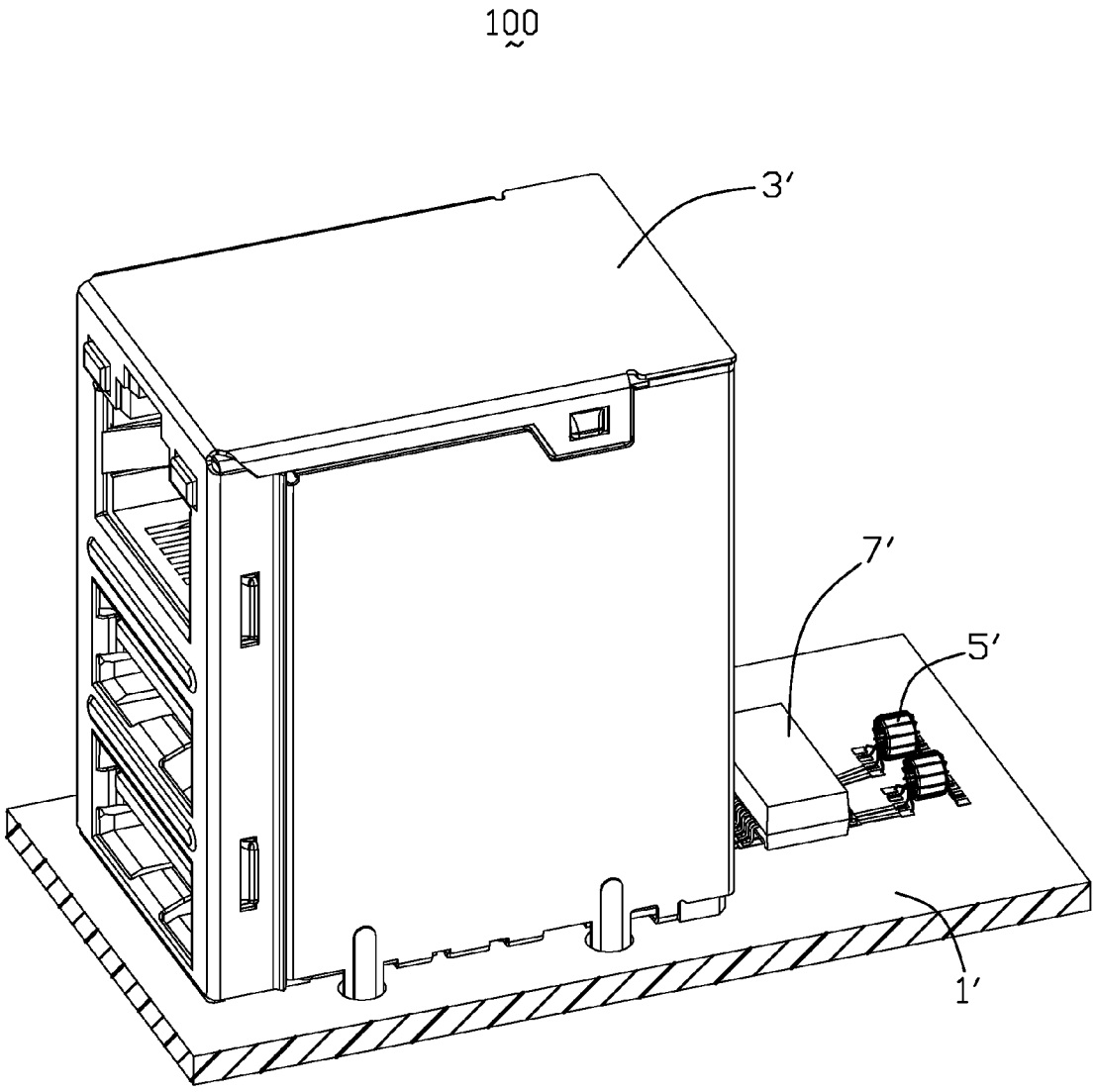
FIG. 4 is a perspective view of an electrical connector system of according to a second prior design.
Figure 5:
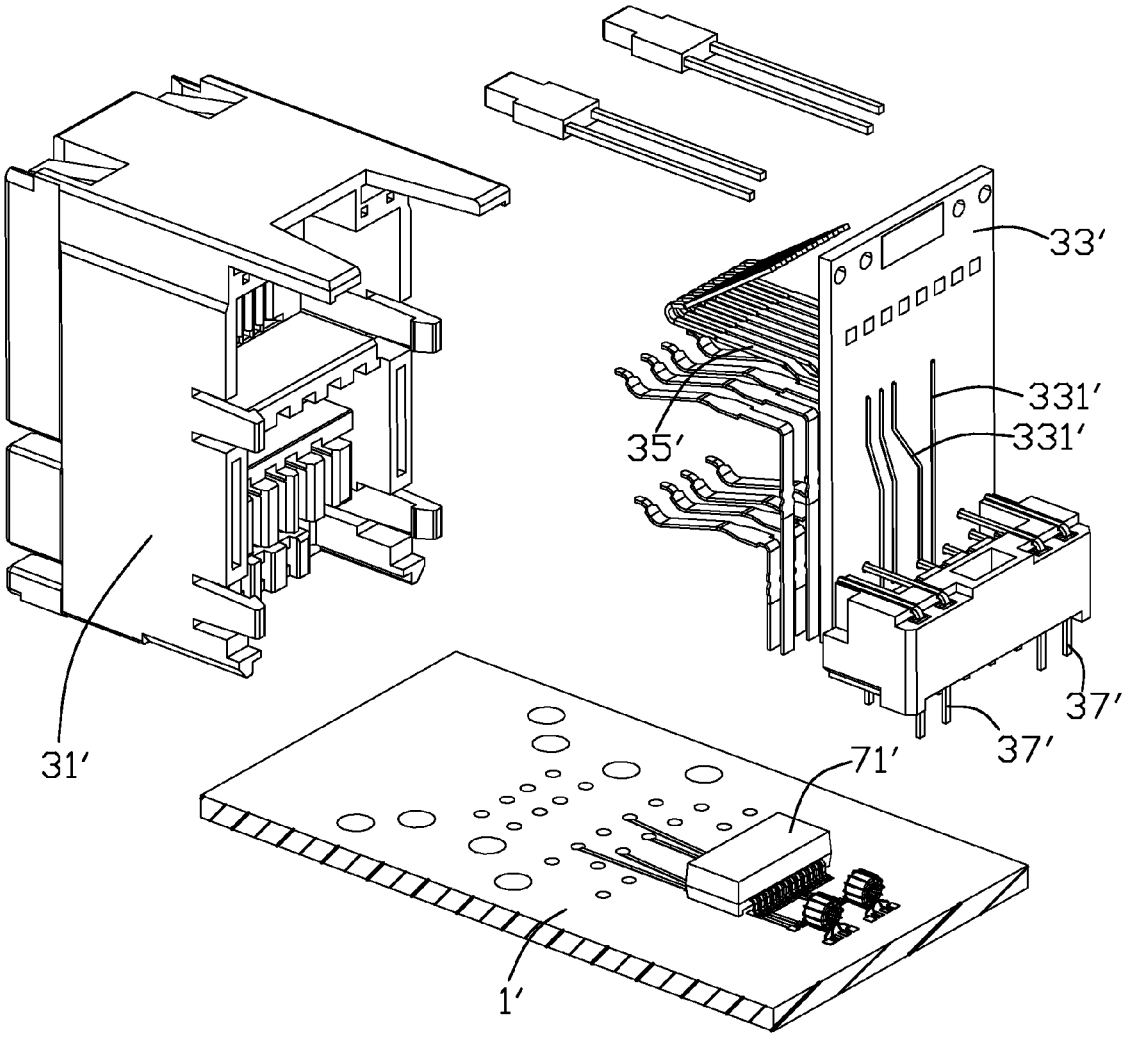
FIG. 5 is an exploded view of the electrical connector system shown in FIG. 4.
Figure 6:
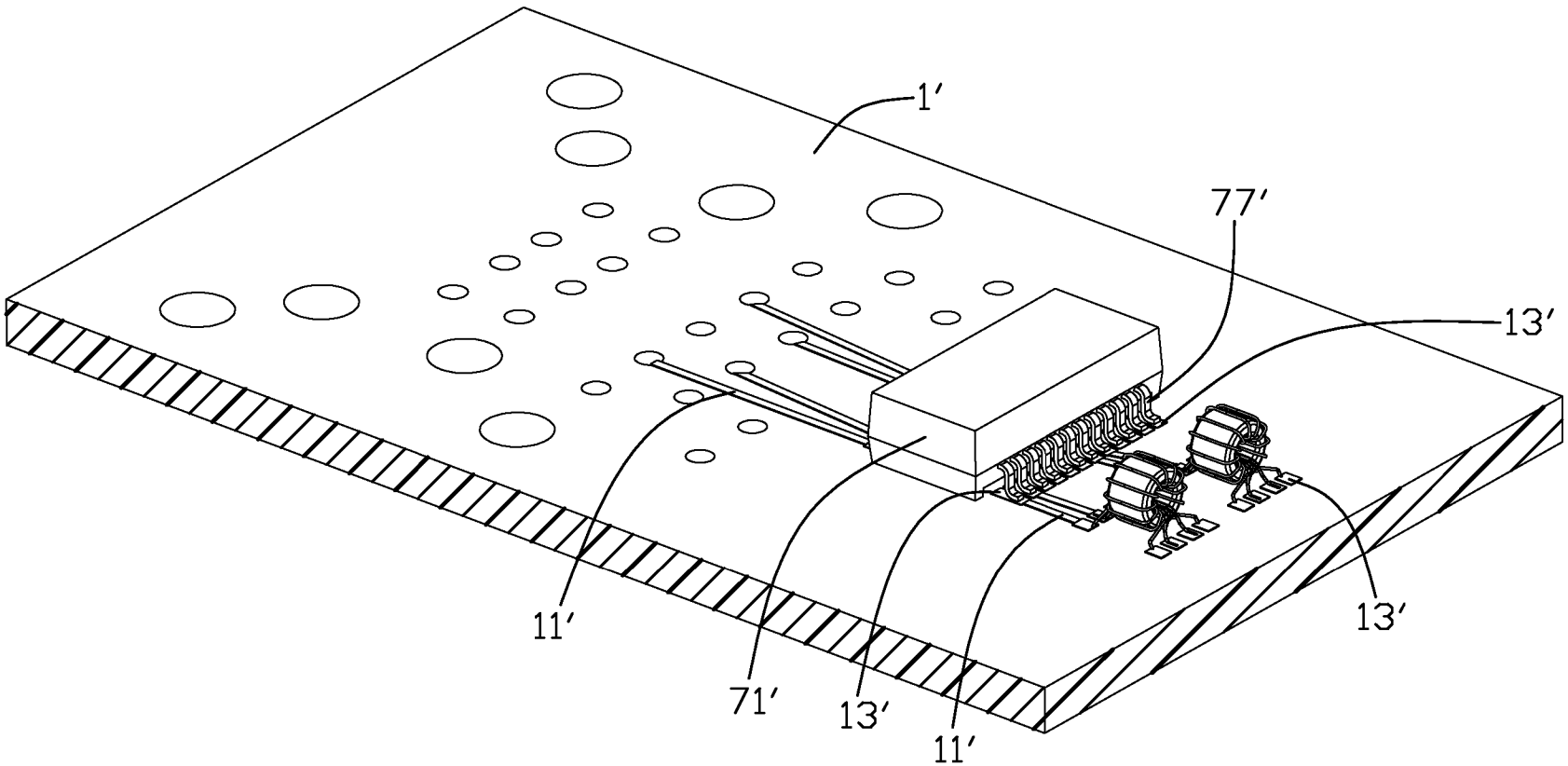
FIG. 6 is a perspective view of a filter portion shown in FIG. 2.

Referring to FIGS. 4-6, an electrical connector system according to a second prior design is shown. The electrical connector system comprises a substrate 1' forming a plurality of conductive traces 11' and an electrical connector 3' mounted on the substrate 1', a transformer 5' and a common mode filter 7'. The transformer 5' further comprises a first wire 51' having two opposite ends electrically connected to the PHY side and a second wire 53' having two opposite ends. The common mode filter 7 has a third wire 73' and a fourth wire 75' that are physically separated from the second wire 53'. The third wire 73' has an end electrically connected to one end of the second wire 53' and an opposite end electrically connected to the Cable side. The fourth wire 75' has an end electrically connected to the opposite end of the second wire 53' and an opposite end electrically connected to the Cable side.

The common mode filter 7' further comprises a plastic container 71', a magnetic core received in the plastic container 71' and a plurality of conductive tails 77' molded together with the plastic container 71'. The third wire 73' and the fourth wire 75' wind around the magnetic core. The ends of the third and the fourth wires 73', 75' are respectively electrically connected to said conductive tails 77'. So, the container 71' makes the common mode filter an integrated common mode module to be assembled conveniently.

Referring to FIGS. 5 and 6, the transformer 5' and the common mode module 7' are mounted on the substrate 1'. The opposite ends of the first wire 51' are electrically connected to the PHY side by some said conductive traces 11' of the substrate 1'. The opposite ends of the second wire 53' are respectively electrically connected to one ends of the third and the fourth wires 73', 75' through some of the conductive pads 13', some of the conductive trace 11' of the substrate 1', some other conductive pads 13', some of the conductive tails 77' and some other of the conductive pads 13'.

The electrical connector 3' further comprises an interior PCB 33'. The interior PCB 33' forms a plurality of conductive traces 331'. The electrical connector 3' further comprises a plurality of mating contacts 35' and a plurality of transferring contacts 37' mounted on the interior PCB. The third and the fourth wires 73', 75' are electrically connected to the Cable side through some conductive tails 77', some conductive traces 11' of the substrate 1', the transferring contacts 37', the conductive traces 331' and the mating contacts 35'.

Figure 7:
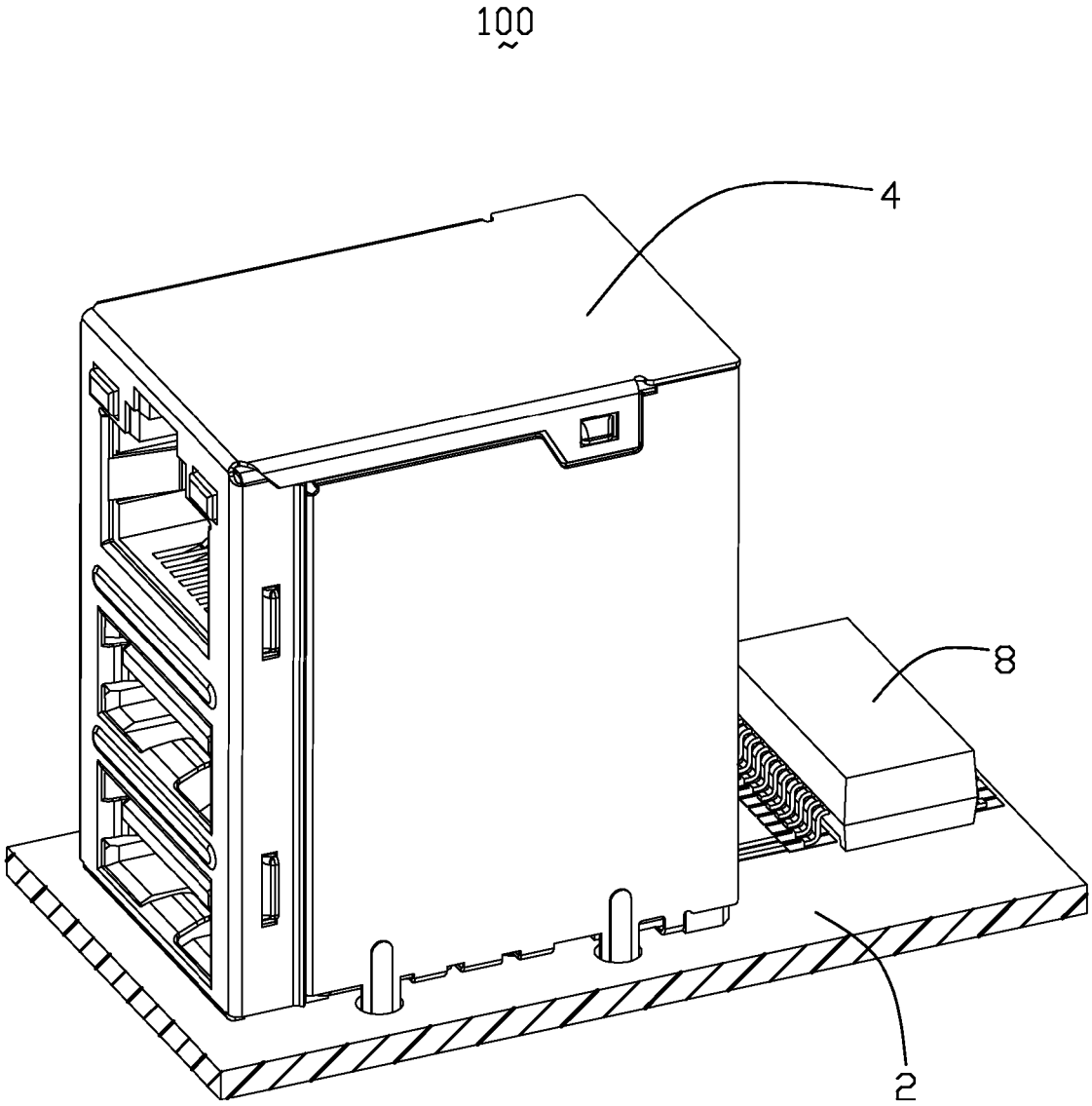
FIG. 7 is a perspective view of an electrical connector system of according to a third prior design.
Figure 8:
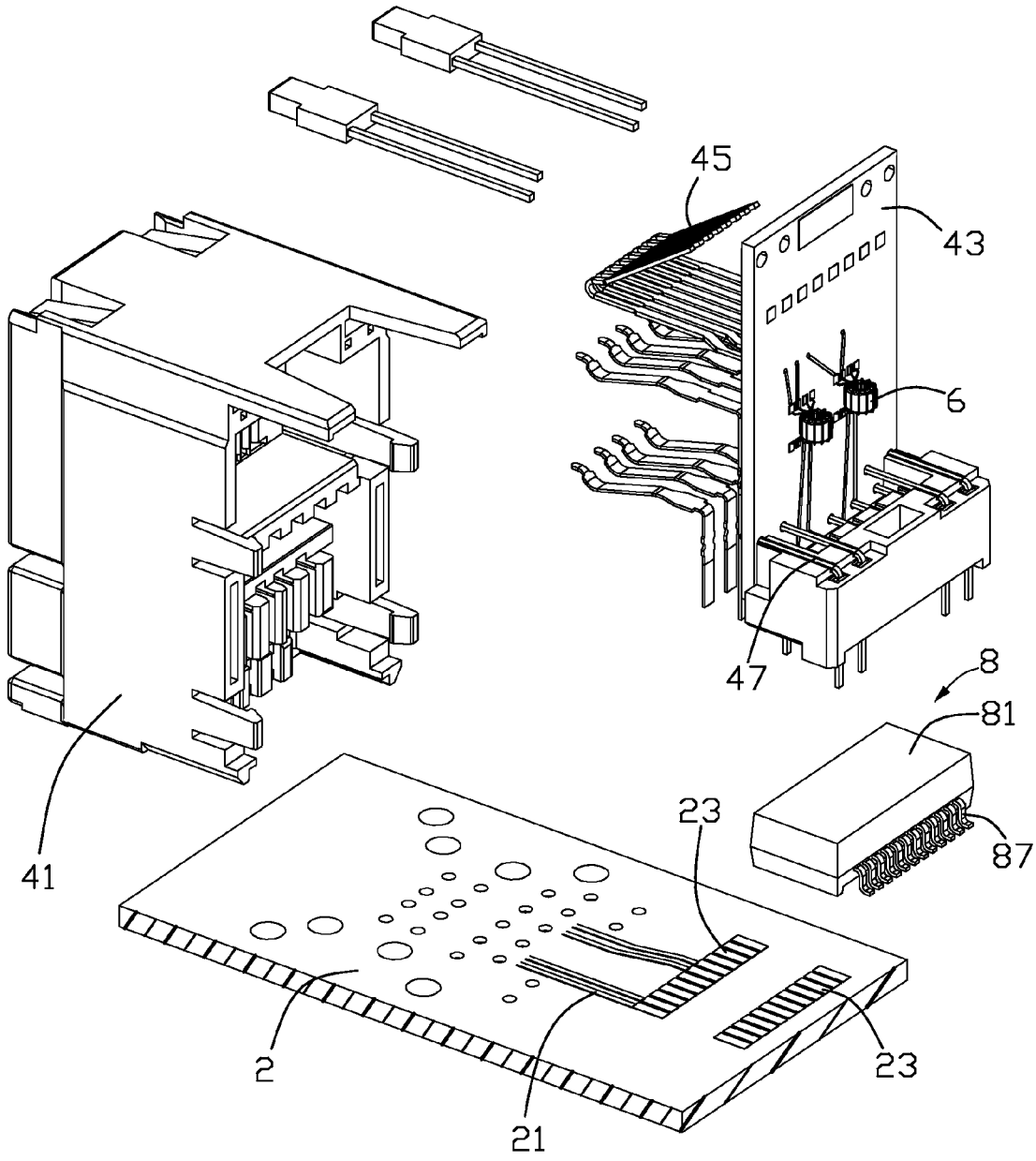
FIG. 8 is an exploded view of the electrical connector system shown in FIG. 7.
Figure 9:
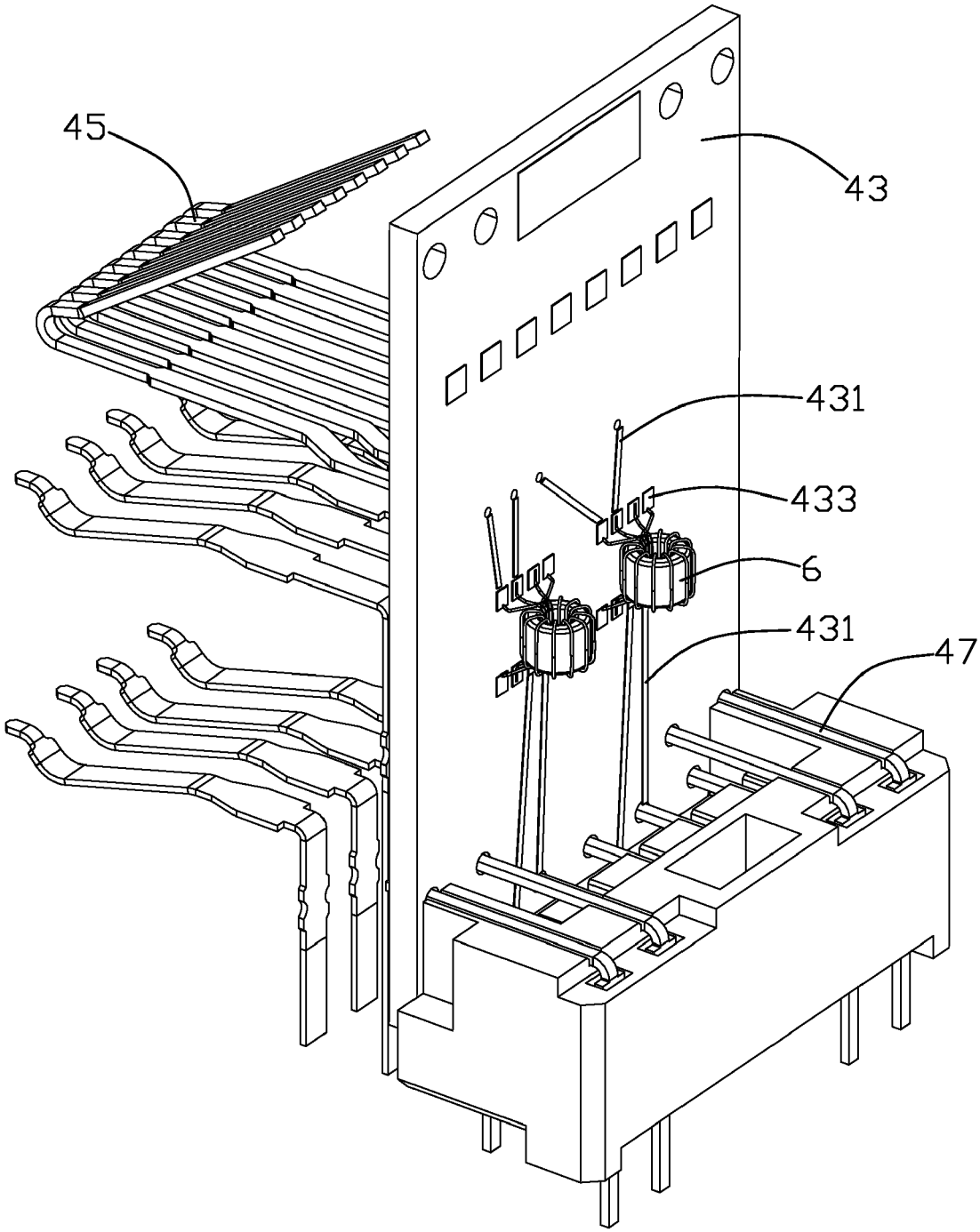
FIG. 9 is a perspective view of a filter portion shown in FIG. 8.

Referring to FIGS. 7-9, an electrical connector system according to a third prior design is shown. The electrical connector system comprises a substrate 2 forming a plurality of conductive traces 21 and an electrical connector 4 mounted on the substrate 2, a transformer 6 and a common mode filter 8. The transformer 6 further comprises a first wire 61 having two opposite ends electrically connected to the Cable side and a second wire 63 having two opposite ends. The common mode filter 8 has a third wire 83 and a fourth wire 85 that are physically separated from the second wire 63. The third wire 83 has an end electrically connected to one end of the second wire 63 and an opposite end electrically connected to the PHY side. The fourth wire 85 has an end electrically connected to the opposite end of the second wire 63 and an opposite end electrically connected to the PHY side. So PHY side and the Cable side are completely opposite to circuit diagram shown in FIG. 12A.

The common mode filter 8 further comprises a plastic container 81, a magnetic core received in the plastic container 81 and a plurality of conductive tails 87 molded together with the plastic container 81. The third wire 83 and the fourth wire 85 wind around the magnetic core. The ends of the third and the fourth wires 83,85 are respectively electrically connected to said conductive tails 87. So, the container 81 makes the common mode filter an integrated common mode module to be assembled conveniently.

Referring to FIGS. 8 and 9, the substrate 2 comprises a plurality of conductive traces 21 and a plurality of conductive pads 23. The common mode module 8 is mounted on the substrate 2. The electrical connector 4 further comprises an interior PCB 43. The interior PCB 43 forms a plurality of conductive traces 431 and a plurality of conductive pads 433. The transformer 6 is mounted on the interior PCB 43. The electrical connector 4 further comprises a plurality of mating contacts 45 and a plurality of transferring contacts 47 mounted on the interior PCB.

Figure 10:
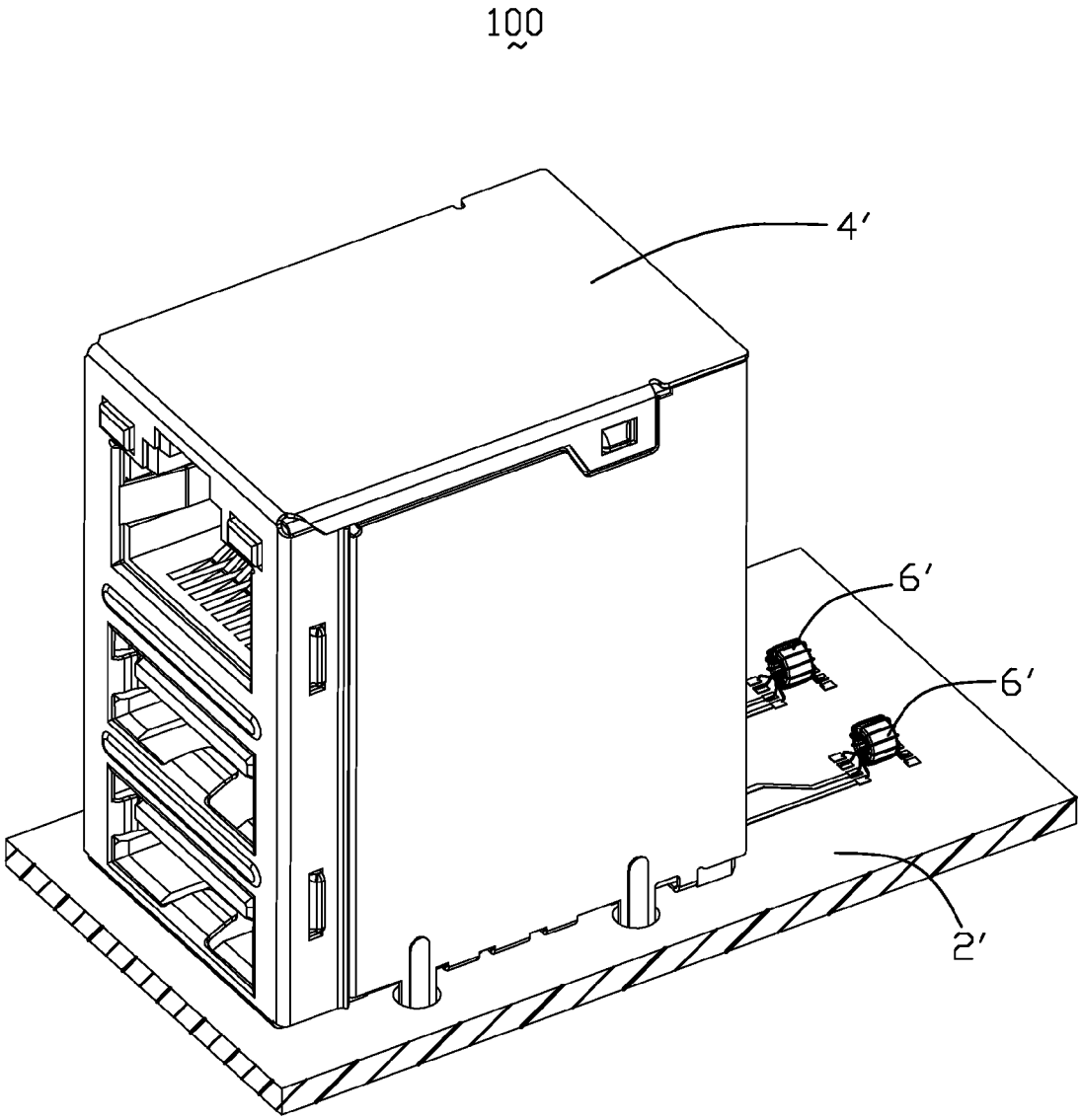
FIG. 10 is a perspective view of an electrical connector system of according to a fourth prior design.
Figure 11:
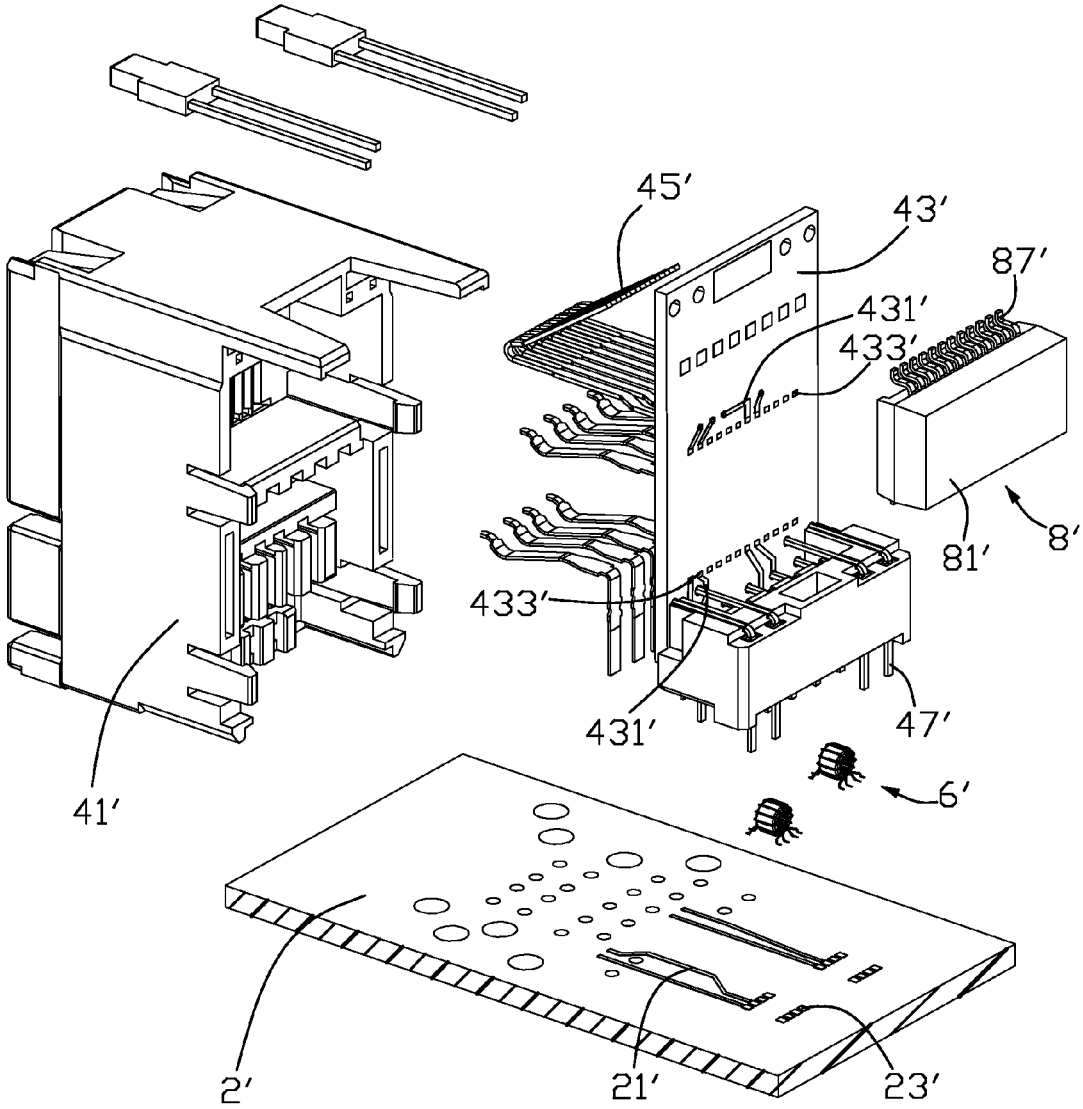
FIG. 11 is an exploded view of the electrical connector system shown in FIG. 10.

Referring to FIGS. 10-11, an electrical connector system according to a fourth prior design is shown. The electrical connector system comprises a substrate 2' forming a plurality of conductive traces 21' and an electrical connector 4' mounted on the substrate 2', a transformer 6' and a common mode filter 8'. The transformer 6' further comprises a first wire 61' having two opposite ends electrically connected to the PHY side and a second wire 63' having two opposite ends. The common mode filter 8' has a third wire 83' and a fourth wire 85' that are physically separated from the second wire 63'. The third wire 83' has an end electrically connected to one end of the second wire 63' and an opposite end electrically connected to the Cable side. The fourth wire 85' has an end electrically connected to the opposite end of the second wire 63' and an opposite end electrically connected to the Cable side. The circuit diagram of the fourth prior design is shown in FIG. 12B.

The common mode filter 8' further comprises a plastic container 81', a magnetic core received in the plastic container 81' and a plurality of conductive tails 87' molded together with the plastic container 81'. The third wire 83' and the fourth wire 85' wind around the magnetic core. The ends of the third and the fourth wires 83', 85' are respectively electrically connected to said conductive tails 87'. So, the container 81' makes the common mode filter an integrated common mode module to be assembled conveniently.

Referring to FIG. 11, the transformer 6' is mounted on the substrate 2'. The electrical connector 4' further comprises an interior PCB 43'. The interior PCB 43' forms a plurality of conductive traces 431' and a plurality of conductive pads 433'. The common mode filter 8' is mounted on the interior PCB 43'. The electrical connector 4' further comprises a plurality of mating contacts 45' and a plurality of transferring contacts 47' mounted on the interior PCB.

Referring back to the third and fourth prior designs, the opposite ends of the second wire 63, 63' and the one ends of the third and the fourth wires are respectively electrically connected through some of the conductive pads 433, 433' and conductive traces 431, 431' of the interior PCB 43, 43', the transferring contacts 47, 47', some of the conductive traces 21, 21' and conductive pads 23, 23' of the substrate 2, 2'. According to the first to the fourth prior designs, the second wire 53, 53', 63, 63' of the transformer 5, 5', 6, 6' is physically separated from the wires of the common mode filter 7, 7', 8, 8', so that the transformer 5, 5', 6, 6' and the common mode filter 7, 7', 8, 8' could be separately manufactured conveniently. Furthermore, the common mode filter 7, 7', 8, 8' and the transformer 5, 5', 6, 6' could be optionally mounted onto the substrate 1, 1', 2, 2' or the interior PCB 33, 33', 43, 43'.

Referring to FIGS. 13-32, twenty electrical connector systems according to first to twentieth embodiments are respectively shown. The twenty embodiments are designed with similar structures to the first to fourth prior designs except that the common mode filter 800 and the transformer 600 are differently designed.

In the twenty embodiments of the present invention, the electrical connector system provides two signal channels and accordingly has two transformers and two common mode filters. The two transformers are incorporated in a plastic container 603 to form an integral transformer module 600. The plastic container 603 is insert-molded with a plurality of conductive tails 601. The first and the second wires 61, 63 of the two transformers have opposite ends respectively electrically connected to said conductive tails 601.

In the first to the fourth embodiments of the present invention (referring to FIGS. 13-16), the connector system has two common mode filters 800 corresponding to the two signal channels. Each of the common mode filters 800 has a third and a fourth wires 83, 85 formed from printed circuit technology. The common mode filter 800 further comprises a plurality of conductive pads 801 respectively attached thereon and electrically connecting opposite ends of the third and the fourth wires 83, 85. The conductive pads 801 are preferred to mount the common mode filter 800 onto corresponding PCB through SMT (surface-mount technology). This type of common mode filter 800 can improve the function of filtering noise.

In the fifth to the eighth embodiments of the present invention (referring to FIGS. 17-20), the connector system has two common mode filters 840 corresponding to the two signal channels. Each of the common mode filters 840 comprises a circle-shaped magnetic core 842 and a third and a fourth wires 83, 85 winding around the magnetic core 842. The third and the fourth wires 83, 85 having opposite ends directly mounted onto corresponding PCB. This type of common mode filter 840 has no container and conductive tail, and therefore the cost for making the same is comparatively low.

In the ninth to the twelfth embodiments of the present invention (referring to FIGS. 21-24), the connector system has a common mode filter module 860. The common mode filter module 860 comprises one plastic container 863 and two common mode filters received therein. The plastic container 863 is configured with a plurality of conductive tails 861. Each of the common mode filter has a third and a fourth wires 83, 85 having opposite ends electrically connected to the conductive tails 861. According to the ninth to the twelfth embodiments of the present invention, the two common mode filters of the two signal channels are both received in the container 863 and form the integral common mode filter module 860, which is beneficial for mounting the filters to corresponding PCB.

In the thirteenth to the sixteenth embodiments of the present invention (referring to FIGS. 25-28), the connector system has two signal channels and accordingly two transformers and two common mode filters 880. Each of the common mode filter 880 comprises an "I" shaped magnetic core 882, a plurality of conductive pads 881 attached thereon, a third and a fourth wires winding around the magnetic core 882. The third and the fourth wires 83, 85 are electrically connected to the conductive pads 881. The "I" shaped magnetic core make it easy to winding the third and the fourth wire 83, 85 around there. The conductive pads 881 are preferred to mount the common mode filter 880 onto corresponding PCB through SMT (surface-mount technology). This type of common mode filter 880 is the cheapest one in all the embodiments of present invention.

In the seventeenth to the twentieth embodiments of the present invention (referring to FIGS. 29-32), the third wires 83 and the fourth wires 83 of the two common mode filters in the two signal channels wind around a common magnetic core 892 and thus form an integral common mode filter 890. It should be understood that if more signal channels were needed, more wires of the common mode filter of the signal channels could be wound around the magnetic core 892. The magnetic core 892 defines two holes 894 cutting there through. The third and the fourth wires 83, 85 wind around the magnetic core and get through the two holes 894. The third and the fourth wires 83, 85 have opposite ends directly mounted onto corresponding PCB.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

We claim:

1. An electrical connector system used for a network interface, said network interface providing signal channel between a first side and a second side, said electrical connector system comprising:

a substrate forming a plurality of conductive traces;

an electrical connector mounted on the substrate;

a transformer having a first wire having two opposite ends electrically connected to said first side and a second wire having two opposite ends;

a common mode filter having a third wire and a fourth wire that are physically separated from the second wire;

wherein the third wire has an end electrically connected to one end of the second wire and an opposite end electrically connected to said second side, and wherein the fourth wire has an end electrically connected to the opposite end of the second wire and an opposite end electrically connected to said second side, thereby a signal channel is formed between the first side and the second side;

wherein the transformer is incorporated into a plastic container, the plastic container is configured with a plurality of conductive tails electrically connected to the opposite ends of the first and the second wires.

2. An electrical connector system according to claim 1, wherein the common mode filter further comprises a magnetic core, the third wire and the fourth wire winding around said magnetic core to form a common mode module for filtering common noise in the signal channel.

3. An electrical connector system according to claim 2, wherein the common mode module further comprises a housing and a plurality of conductive tails, said housing defining a cavity for receiving the magnetic core, the third and the fourth wires, the ends of the third and the fourth wires being respectively electrically connected to said conductive tails.

4. An electrical connector system according to claim 3, wherein the electrical connector further comprises an interior PCB, the interior PCB forming a plurality of conductive traces, the transformer and the common mode module being mounted on the interior PCB, the opposite ends of the second wire being respectively electrically connected to the ends of the third and the fourth wires through some of the conductive traces of the interior PCB and the conductive tails.

5. An electrical connector system according to claim 3, wherein the transformer module and the common mode module are mounted on the substrate, the ends of the second wire being respectively electrically connected to the ends of the third and the fourth wires through some of the conductive traces of the substrate.

6. An electrical connector system according to claim 3, wherein said electrical connector further comprises an interior PCB mounted inside the electrical connector, a plurality of mating contacts mounted on the interior PCB for mating with a complimentary connector and a plurality of transferring contacts connecting the interior PCB to the substrate, said transformer being mounted on the interior PCB and said common mode module being mounted on the substrate.

7. An electrical connector system according to claim 3, wherein said electrical connector further comprises an interior PCB mounted inside the electrical connector, a plurality of mating contacts mounted on the interior PCB for mating with a complimentary connector and a plurality of transferring contacts connecting the interior PCB to the substrate, said common mode module being mounted on the interior PCB and said transformer being mounted on the substrate.

8. An electrical connector system according to claim 1, wherein the third and the fourth wires of the common mode filter are manufactured through printed circuit technology.

9. An electrical connector system according to claim 8, wherein the common mode filter further comprises a plurality of conductive pads attached thereon and respectively electrically connecting opposite ends of the third and the fourth wires.

10. An electrical connector system according to claim 1, wherein the common mode filter further comprises a circle-shaped magnetic core, the third and the fourth wires winding around the magnetic core.

11. An electrical connector system according to claim 1, wherein the common mode filter is incorporated into a plastic container to form a module, a plurality of conductive tails molded together with the plastic container, opposite ends of the third and the fourth wires respectively electrically connected to corresponding conductive tails.

12. An electrical connector system according to claim 11, wherein there are two signal channels, and wherein the two common mode filters of the two channels are received in the plastic container.

13. An electrical connector system according to claim 1, wherein the common mode filter further comprises an "I" shaped magnetic core, a plurality of conductive pads attached thereon, the third and the fourth wires winding around the magnetic core and having opposite ends electrically connected to corresponding conductive pads.

14. An electrical connector system according to claim 1, wherein there are two signal channels, the third wires and fourth wires of said two signal channels winding around one magnetic core.

15. An electrical connector system according to claim 1, wherein the magnetic core defines two holes cutting there through, the third and the fourth wires winding around the magnetic core and getting through the two holes.

16. An electrical connector comprising:

opposite first side and second side;

a transformer having a first wire having two opposite ends electrically connected to said first side and a second wire having two opposite ends;

a common mode filter having a third wire and a fourth wire that are physically separated from the second wire;

wherein the third wire, the fourth wire and the second wire are connected with one another in a serial manner that the second wire is located between the third wire and the fourth wire, and free ends of said third wire and said fourth wire are connected to the second side, thereby a signal channel is formed between the first side and the second side;

wherein the transformer is incorporated into a plastic container, and the plastic container is configured with a plurality of conductive tails electrically connected to opposite ends of the first and the second wires.

17. An electrical connector according to claim 16 further comprising an interior PCB, and wherein the plastic container is surface-mounted onto the interior PCB.

18. An electrical connector comprising:

opposite first side and second side;

a transformer having a first wire having two opposite ends electrically connected to said first side and a second wire having two opposite ends;

a common mode filter having a third wire and a fourth wire that are physically separated from the second wire;

wherein the third wire, the fourth wire and the second wire are connected with one another in a serial manner that the second wire is located between the third wire and the fourth wire, and free ends of said third wire and said fourth wire are connected to the second side, thereby a signal channel is formed between the first side and the second side;

wherein the transformer includes a plurality of resilient conductive tails highly densely arranged with one another and electrically connected to opposite ends of the first and the second wires for surface mounting to a printed circuit board.

19. The electrical connector as claimed in claim 18, wherein both said transformer and said common mode filter are commonly mounted to said printed circuit board.

* * * * *